US005297046A

United States Patent [19]

Nakaniwa

[11] Patent Number: 5,297,046

[45] Date of Patent: Mar. 22, 1994

[54] SYSTEM AND METHOD FOR LEARNING AND CONTROLLING AIR/FUEL MIXTURE RATIO FOR INTERNAL COMBUSTION ENGINE

[75] Inventor: Shinpei Nakaniwa, Gumma, Japan

[73] Assignee: Japan Electronic Control Systems Co., Ltd., Isezaki, Japan

[21] Appl. No.: 869,341

[22] Filed: Apr. 16, 1992

[30] Foreign Application Priority Data

Apr. 17, 1991 [JP] Japan ..... 3-085421
Apr. 19, 1991 [JP] Japan ..... 3-088658

[51] Int. Cl.[5] ..... F02D 41/14
[52] U.S. Cl. ..... 364/431.05; 123/674
[58] Field of Search ..... 364/431.04, 431.05, 364/571.01; 123/480, 486, 417, 672, 674, 679; 395/905, 913

[56] References Cited

U.S. PATENT DOCUMENTS

| | | | |
|---|---|---|---|
| 4,788,958 | 12/1988 | Nakajima et al. | 123/674 |
| 4,800,857 | 1/1989 | Tomisawa | 123/674 |
| 4,825,837 | 5/1989 | Nakagawa | 123/681 |
| 4,941,488 | 7/1990 | Nakaniwa et al. | 123/684 X |
| 5,099,817 | 3/1992 | Nakaniwa | 123/674 |

FOREIGN PATENT DOCUMENTS

| | | |
|---|---|---|
| 60-90944 | 5/1985 | Japan . |
| 61-190142 | 8/1986 | Japan . |
| 63-129150 | 6/1988 | Japan . |
| 3-145539 | 6/1991 | Japan . |

*Primary Examiner*—Kevin J. Teska
*Assistant Examiner*—Ed Pipala
*Attorney, Agent, or Firm*—Foley & Lardner

[57] ABSTRACT

A system and method for learning and controlling an air/fuel mixture ratio for an internal combustion engine are disclosed which can achieve the compatibility of both learning convergence characteristic and accuracy of learning and which can prevent a stepwise change in correction coefficients to a basic fuel supply quantity when the present engine driving condition makes the present one of the driving conditions to the other one of the driving conditions. In a preferred embodiment of the air/fuel mixture ratio learning and controlling system, a plurality of learning maps in which the whole driving region is divided into 16 regions and is divided into 258 regions. The learnings of the air/fuel mixture ratio learning correction coefficients KBLRC1 for the 16 driving regions on the first learning map are followed by those of the other air/fuel mixture ratio learning correction coefficients KBLRC2 for the 256 driving regions on the second learning map. After loads of corrections on the learning correction coefficients KBLRC1 are transferred to those of the learning correction coefficients KBLRC2 for the 256 driving regions, the system reads a modified learning correction coefficient KBLRC2 derived through an interpolation between the 256 region learning map. A final learning correction coefficient KBLRC is set using the read correction coefficient KBLRC2 and the learning correction coefficient KBLRC0 applied to the whole driving region so as to correct the basic fuel supply quantity.

21 Claims, 16 Drawing Sheets

SYSTEM AND METHOD FOR LEARNING AND CONTROLLING AIR/FUEL MIXTURE RATIO FOR INTERNAL COMBUSTION ENGINE

BACKGROUND OF THE INVENTION (1) Field of the Invention

The present invention relates to a system and method for learning and controlling an air/fuel mixture ratio for an internal combustion engine and, more particularly, relates to the system and method therefor in which a supply quantity of fuel to the engine is corrected so that an actual air/fuel mixture ratio sucked into the engine coincides with a target air/fuel mixture ratio.

(2) Description of the Background Art

Japanese Patent Application First Publications No. showa 60-90944 published on May 22, 1985 and No. Showa 61-190142 published on Aug. 23, 1986 exemplify electronically controlled fuel injection systems with air/fuel mixture ratio feedback correction controlling functions in which the air/fuel mixture ratio is learned and controlled.

The correction control of the air/fuel mixture ratio is such that an oxygen concentration sensor installed in an engine exhaust system is used to determine a rich or lean state of the actual air/fuel mixture ratio with respect to a target air/fuel mixture ratio (for example, a stoichiometric air/fuel mixture ratio) and an air/fuel mixture ratio feedback correction coefficient LMD used to correct a fuel injection quantity is set on a basis of the result of determination of the rich or lean state of the actual air/fuel mixture ratio at a proportion-and-integration control. A basic fuel injection quantity Tp calculated from a parameter of the engine driving condition related to an intake air quantity sucked into the engine (for example, sucked (intake) air quantity Q and engine revolution speed N) is corrected with the air/fuel mixture ratio feedback correction coefficient LMD so that the actual air/fuel mixture ratio is coincident with the target air/fuel mixture ratio.

Then, a deviation of the actual air/fuel mixture ratio feedback correction coefficient LMD from a reference value (a target or finally converged value) is learned for each of a plurality of previously defined engine driving regions (or driving area) so as to define a learning correction coefficient KBLRC (learning correction value of the air/fuel mixture ratio). The basic fuel injection quantity Tp is corrected with the learning correction coefficient KBLRC so that a basic air/fuel mixture ratio derived without the correction coefficient LMD is controlled so as to substantially match with the target (stoichiometric) air/fuel mixture ratio. In addition, during the execution of the air/fuel mixture ratio feedback control, the basic air/fuel mixture ratio is further corrected with the correction coefficient LMD to calculate a final fuel injection quantity Ti.

Consequently, a fuel supply correction corresponding to a different correction request which is different for each engine driving condition can be carried out.

Then, the air/fuel mixture ratio feedback correction coefficient LMD can become stable in the vicinity to the reference value so that an air/fuel mixture ratio controllability can be improved.

On the other hand, since the air/fuel mixture ratio learning correction coefficient KBLRC is set to cope with the different air/fuel mixture ratio correction request generated according to the different driving conditions as described above, it is desirable to learn the learning correction coefficient KBLRC with the engine driving regions divided as close as possible.

However, if the whole driving region is closely divided into the plurality of the engine driving regions and the learning correction coefficient KBLRC for each engine driving region is learned, an opportunity of learning is reduced at each driving region and a convergence characteristic of the learning is worsened. Then, since any one of the regions in which the learning is carried out and any other regions in which no learning is carried out are mixed in the whole driving region, a large stepwise difference in the air/fuel mixture ratio between the respective driving regions occurs.

A Japanese Patent Application First Publication No. Heisei 3-145539 published on Jun. 20, 1991 exemplifies a previously proposed air/fuel mixture ratio learning and controlling system in which a plurality of learning maps are installed in which the number of divisions of the engine driving regions are different from each other, the learning of the learning correction coefficient KBLRC is started from one of the learning maps in which the number of divisions of the driving regions is less than the others and the driving region for a unit of learning is wider from among the learning maps and the learning is transferred to one of the learning maps in which the number of divisions are greater than the others and the driving region for the unit of learning is narrower as the learning is advanced.

In the air/fuel mixture ratio learning according to the disclosed air/fuel mixture ratio learning and controlling system, the favorable learning convergence characteristic can be secured by learning the learning correction coefficient KBLRC for each unit of engine driving region at the initial state of learning and the air/fuel mixture ratio learning is carried out for the closer engine driving region as the learning is advanced, the accurate learning of the air/fuel mixture ratio can be carried out so as to cope with the different correction request for the different engine driving condition.

However, in the latter previously proposed air/fuel mixture ratio learning and controlling system described above, the plurality of learning maps are installed which store the air/fuel mixture ratio learning correction values for the respective engine driving regions. Therefore, a large capacity of memories is required.

In addition, since the learning correction values are learned as representative values in the respectively divided driving regions, it is inevitable to change stepwise the learning correction values when the driving regions on the learning maps are switched and the stepwise changes in the learning correction values generate variations in the air/fuel mixture ratio.

In details, although the errors in the basic air/fuel mixture ratio are generated due to various causes, the basic air/fuel mixture ratio is not varied stepwise for the change in the driving conditions and the request for the air/fuel mixture ratio learning correction value is inherently not varied stepwise.

However, since, as described above, the air/fuel mixture ratio learning correction values as the representative correction levels in the driving regions having a certain magnitude are learned, the stepwise change in the learning correction value which does not correspond to the change in the actual driving condition when the change in the driving condition which crosses the boundaries of the driving regions. Although the change width of the stepwise learning correction values can be reduced when the learning driving region is narrowed, it is not practical to divide the driving regions as close as possible in the case where the learning is such as to gradually narrow the learning region. It is inevitable to generate the stepwise difference in correction levels from among the regions on the learning maps.

SUMMARY OF THE INVENTION

It is an object of the present invention to provide an improved system and method for learning and controlling an air/fuel mixture ratio which can achieve the learning of the air/fuel mixture ratio having the compatibility of the convergence characteristic of the learning and accuracy of learning of the air/fuel mixture ratio, saving a memory capacity.

It is another object of the present invention to provide the system and method described above in which the accurate air/fuel mixture ratio learning for each driving condition is carried out and a speedy convergence of the learning can be assured during the abrupt change in the basic air/fuel mixture ratio.

It is still another object of the present invention to provide the system and method described above in which while the air/fuel mixture ratio learning is carried out for each closely divided driving condition with the convergence characteristic of the learning assured, a stepwise change in the actual correction due to the stepwise difference in correction levels in-between the driving regions on the learning maps being avoided so that the learning corrections for the air/fuel mixture ratio used in the corrections with respect to the change in the driving conditions are smoothly varied with good accuracy.

The above-described objects can be achieved by providing a system for learning and controlling an air/fuel mixture ratio for an internal combustion engine, comprising: a) first means for detecting an engine driving condition including a driving parameter related to an intake air quantity sucked into the engine; b) second means for setting a basic fuel supply quantity on the basis of the engine driving condition; c) third means for detecting the air/fuel mixture ratio of the intake air mixture fuel; d) fourth means for comparing the detected air/fuel mixture ratio with a target air/fuel mixture ratio and for setting an air/fuel mixture ratio feedback correction coefficient used to correct the basic fuel supply quantity so as to make the actual air/fuel mixture ratio approach to the target air/fuel mixture ratio; e) fifth means for rewritably storing a learning correction coefficient for each driving region, the whole driving region being divided into a plurality of driving regions according to the engine driving condition, the learning correction coefficient being used to correct the basic fuel supply quantity; e) sixth means for learning a deviation of a value of the air/fuel mixture ratio feedback correction coefficient to a target convergence value and for modifying and rewriting the air/fuel mixture ratio learning correction coefficient stored so as to correspond to one of the driving regions in the fifth means so that the deviation thereof is reduced; f) seventh means for determining the present corresponding driving region in the fifth means as a learned region when the value of the air/fuel mixture ratio feedback correction coefficient substantially coincides with the target convergence value and for storing a result of determination of the learned region according to each driving region; g) eighth means for estimatingly learning the air/fuel mixture ratio learning correction coefficients corresponding to the other driving regions which are adjacent in terms of the driving condition to one of the driving regions at which the corresponding learning correction coefficient is rewritten by the sixth means; h) ninth means for controlling the estimatingly learning of the eighth means according to a number of rewritten driving regions at which the corresponding air/fuel mixture ratio learning correction coefficients are rewritten by the eighth means together with the rewritten learning correction coefficient by the sixth means such that the number of the rewritten driving regions is decreased as the number of learned driving regions is increased; and i) tenth means for driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

The above-described objects can also be achieved by providing a system for learning and controlling an air/fuel mixture ratio for an internal combustion engine, comprising: a) first means for detecting an engine driving condition including a driving parameter related to an intake air quantity sucked into the engine; b) second means for setting a basic fuel supply quantity on the basis of the engine driving condition; c) third means for detecting the air/fuel mixture ratio of the intake air mixture fuel; d) fourth means for comparing the detected air/fuel mixture ratio with a target air/fuel mixture ratio and for setting an air/fuel mixture ratio feedback correction coefficient used to correct the basic fuel supply quantity so as to make the actual air/fuel mixture ratio approach to the target air/fuel mixture ratio; e) fifth means having at least one learning map for rewritably storing a learning correction coefficient for each driving region, the whole driving region being divided into a plurality of driving regions according to the engine driving condition, the learning correction coefficient being used to correct the basic fuel supply quantity; e) sixth means for learning a deviation of a value of the air/fuel mixture ratio feedback correction coefficient to a target convergence value and for modifying and rewriting the air/fuel mixture ratio learning correction coefficient stored so as to correspond to one of the driving regions in the fifth means so that the deviation thereof is reduced; f) seventh means for determining the present corresponding driving region in the fifth means as a learned region when the value of the air/fuel mixture ratio feedback correction coefficient substantially coincides with the target convergence value and for storing a result of determination of the learned region according to each driving region; g) eighth means for learning the air/fuel mixture ratio learning correction coefficients corresponding to the other driving regions so as to prevent a stepwise difference between the learning correction coefficients in the learning map of the fifth means when the driving conditions varied from the one driving region to one of the other driving regions, the other driving regions being adjacent in terms of the driving condition to the one driving region at which the corresponding learning correction coefficient is rewritten by the sixth means; h) ninth means for controlling the estimating and learning of the eighth means according to a number of rewritten driving regions at which the corresponding air/fuel mixture ratio learning correction coefficients are rewritten by the eighth means together with the rewritten learning correction coefficient by the sixth means such that the number of the rewritten driving regions is decreased as the number of learned driving regions is increased; and i) tenth means for driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

The above-described objects can also be achieved by providing a method for learning and controlling an air/fuel mixture ratio for an internal combustion engine, comprising the steps of; a) detecting an engine driving condition including a driving parameter related to an intake air quantity sucked in to the engine; b) setting a basic fuel supply quantity on the basis of the engine driving condition; c) detecting the air/fuel mixture ratio of the intake air mixture fuel; d) comparing the detected air/fuel mixture ratio with a target air/fuel mixture ratio and setting an air/fuel mixture ratio feedback correction coefficient used to correct the basic fuel supply quantity so as to make the actual air/fuel mixture ratio approach to the target air/fuel mixture ratio; e) rewritably storing a learning correction coefficient for each driving region, the whole driving region being divided into a plurality of driving regions according to the engine driving condition, the learning correction coefficient being used to correct the basic fuel supply quantity; e) learning a deviation of a value of the air/fuel mixture ratio feedback correction coefficient to a target convergence value and modifying and rewriting the air/fuel mixture ratio learning correction coefficient stored so as to correspond to one of the driving regions so that the deviation thereof is reduced; f) determining the present corresponding driving region in the fifth means as a learned region when the value of the air/fuel mixture ratio feedback correction coefficient substantially coincides with the target convergence value and for storing a result of determination of the learned region according to each driving region; g) estimating and learning the air/fuel mixture ratio learning correction coefficients corresponding to the other driving regions which are adjacent in terms of the driving condition to one of the driving regions at which the corresponding learning correction coefficient is rewritten in the step e); h) controlling the estimation and learning carried out in the step g) according to a number of rewritten driving regions at which the corresponding air/fuel mixture ratio learning correction coefficients are rewritten by the eighth means together with the rewritten learning correction coefficient in the step e) such that the number of the rewritten driving regions is decreased as the number of learned driving regions is increased; and i) driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

BRIEF DESCRIPTION OF THE DRAWINGS

FIG. 11(B) is an enlarged view of the circled portion in FIG. 11(A).

DETAILED DESCRIPTION OF THE PREFERRED EMBODIMENTS

Reference will hereinafter be made to the drawings in order to facilitate a better understanding of the present invention.

First preferred embodiment

Figure 1:
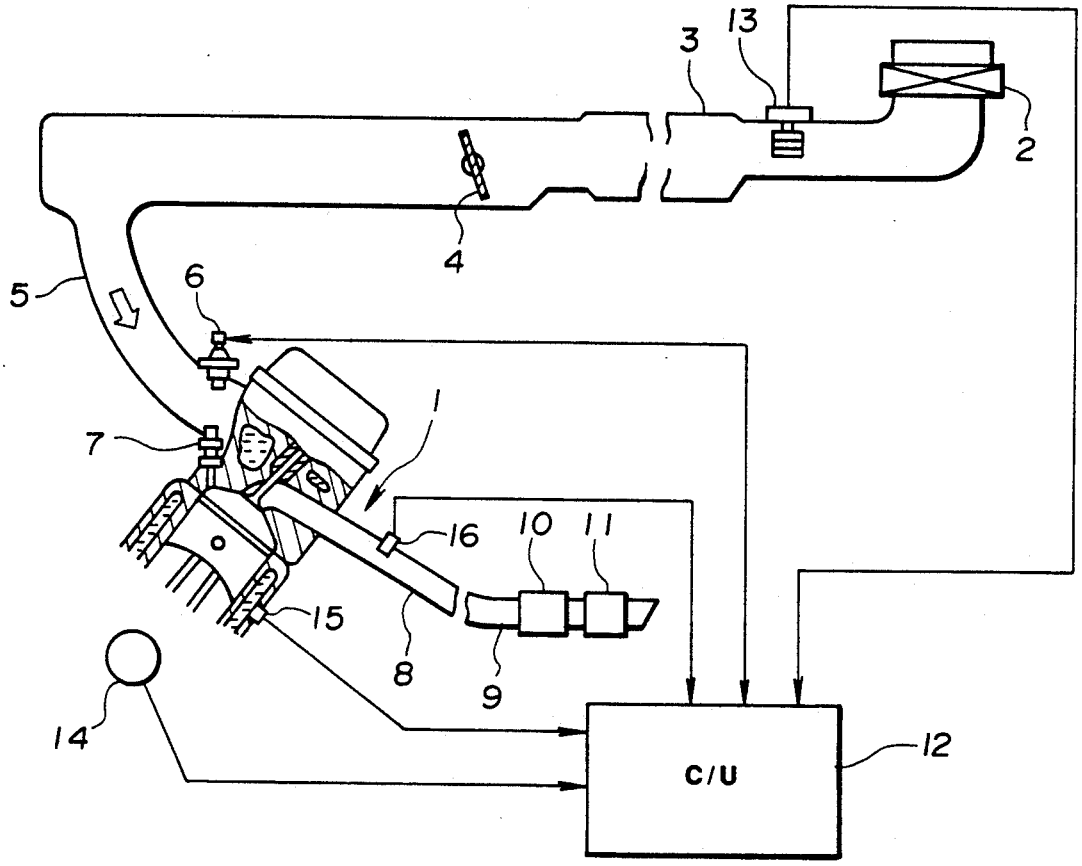
FIG. 1 is a circuit block diagram of a system for learning and controlling an air/fuel mixture ratio for an internal combustion engine in a first preferred embodiment according to the present invention.

FIG. 1 shows a circuit block diagram of a system for learning and controlling an air/fuel mixture ratio applicable to an internal combustion engine.

In FIG. 1, an air is sucked into an engine 1 from an air cleaner 2 via an intake air duct 3, throttle valve 4, and intake manifold 5.

Each branch portion of the intake air manifold 5 is provided with a fuel injection valve 6 as fuel supplying means for the respective cylinders. The fuel injection valves 6 are open by their solenoids in response to the energizations by input electric signals supplied thereto and closed in response to de-energizations from the input signals.

A control unit 12 to be described later outputs the electrical signals which are pulse drive signals to the respective fuel injection valves 6 to open the fuel injection valves 6 through which a given amount of fuel which is pressurized by means of pressure regulators under a predetermined pressure is intermittently supplied and injected into the engine 1.

Each combustion chamber of the engine 1 is provided with an ignition plug 7 which ignites and burns an air mixed fuel. The exhaust gas from the engine 1 is exhausted cia an exhaust manifold 8, exhaust gas duct 9, a three-catalytic converter 10 and muffler 11.

The control unit 12 is constituted by a microcomputer including a CPU (Central Processing Unit), ROM (Read Only Memory), RAM (Random Access Memory), and A/D converters, and I/O interface. The control unit 12 receives various sensor signals, executed various calculation processings, and controls the operations of the fuel injection valves 6.

The various sensors include an airflow meter 13 located in the intake air duct 3 for outputting a signal corresponding to an intake air quantity Q of the engine 1. In addition, a crank angle sensor 14 is installed, which outputs a reference signal REF whenever a crankshaft rotates through 180° C. in a case of a four-cylinder engine and outputs a unit angle signal POS of 1° rotation or 2° rotation. It is noted that if the period of the reference signal REF or the number of pulses of the unit angle signal POS of 2° is measured, the number of engine revolutions per time (engine revolution speed) N can be calculated. In addition, a coolant temperature Tw is measured by means of a coolant temperature sensor Tw of a water jacket of the engine 1.

An oxygen (concentration) sensor 18 as the air/fuel mixture ratio controlling means is installed in a collecting portion of the exhaust manifold 8. The air/fuel mixture ratio of a mixture fuel is detected via an oxygen concentration in the exhaust gas. The oxygen sensor 16 detects rich or lean state of an actual air/fuel mixture ratio with respect to the stoichiometric air/fuel mixture, utilizing an abrupt change in the oxygen concentration of the exhaust gas with the stoichiometric air/fuel mixture ratio as a center. It is noted that in the first preferred embodiment a relatively high voltage signal is output when the actual air/fuel mixture ratio becomes richer and a relatively low voltage signal (near to zero) is output when the actual air/fuel mixture ratio becomes lean.

In the preferred embodiment, the CPU of the microcomputer incorporated in the control unit 12 carries out the series of calculation processings in accordance with programs stored in the ROM and shown in FIGS. 2 through 6. The control unit 12 sets the fuel injection quantity Ti executing the correction control of the air/fuel mixture ratio feedback and the air/fuel mixture ratio learning correction control for each engine driving region, the fuel supply to the engine 1 being controlled.

Figure 2:
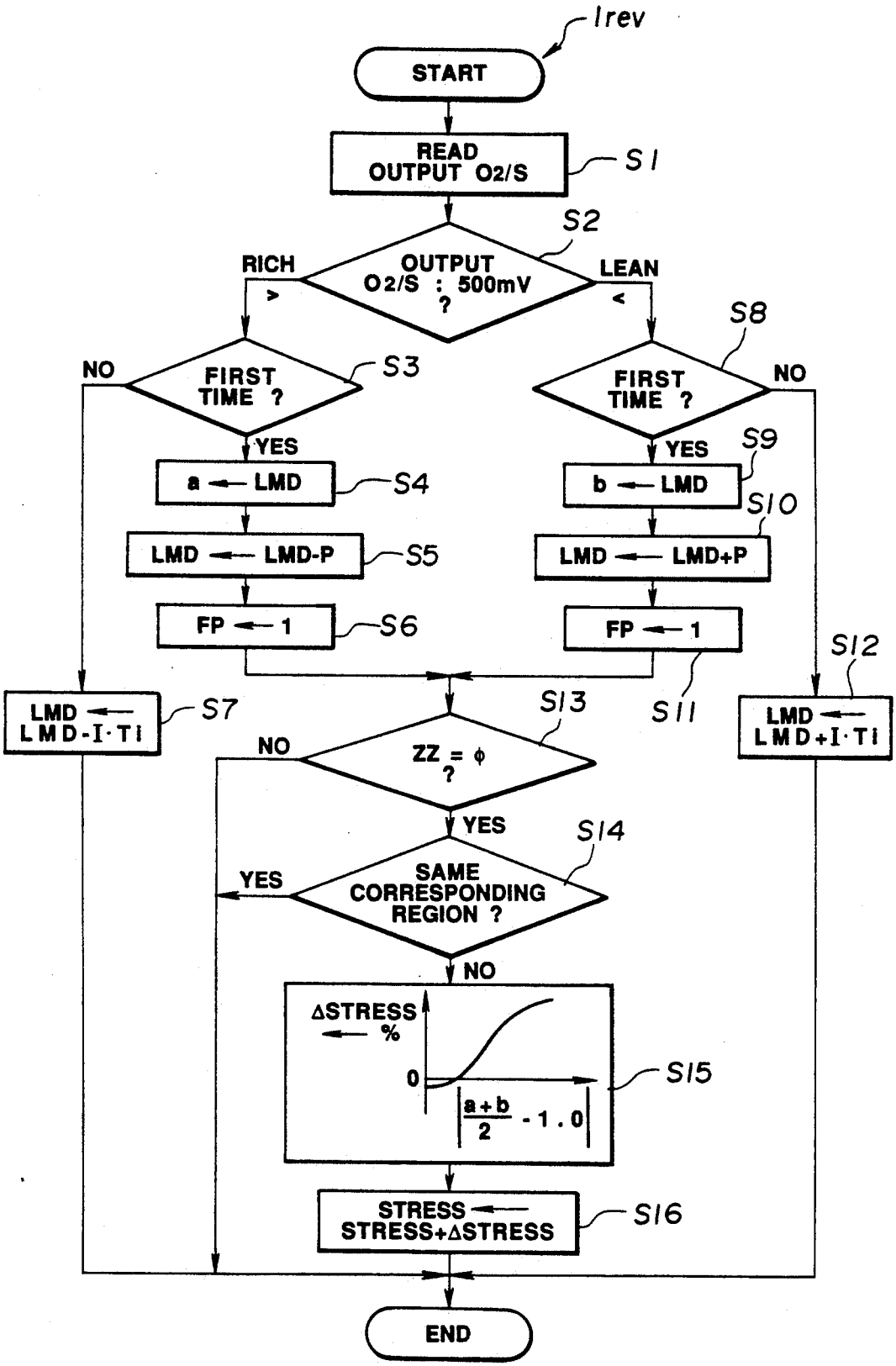
FIG. 2 is an operational flowchart for explaining an air/fuel mixture ratio feedback control routine executed in the first preferred embodiment shown in FIG. 1.
Figure 3A:
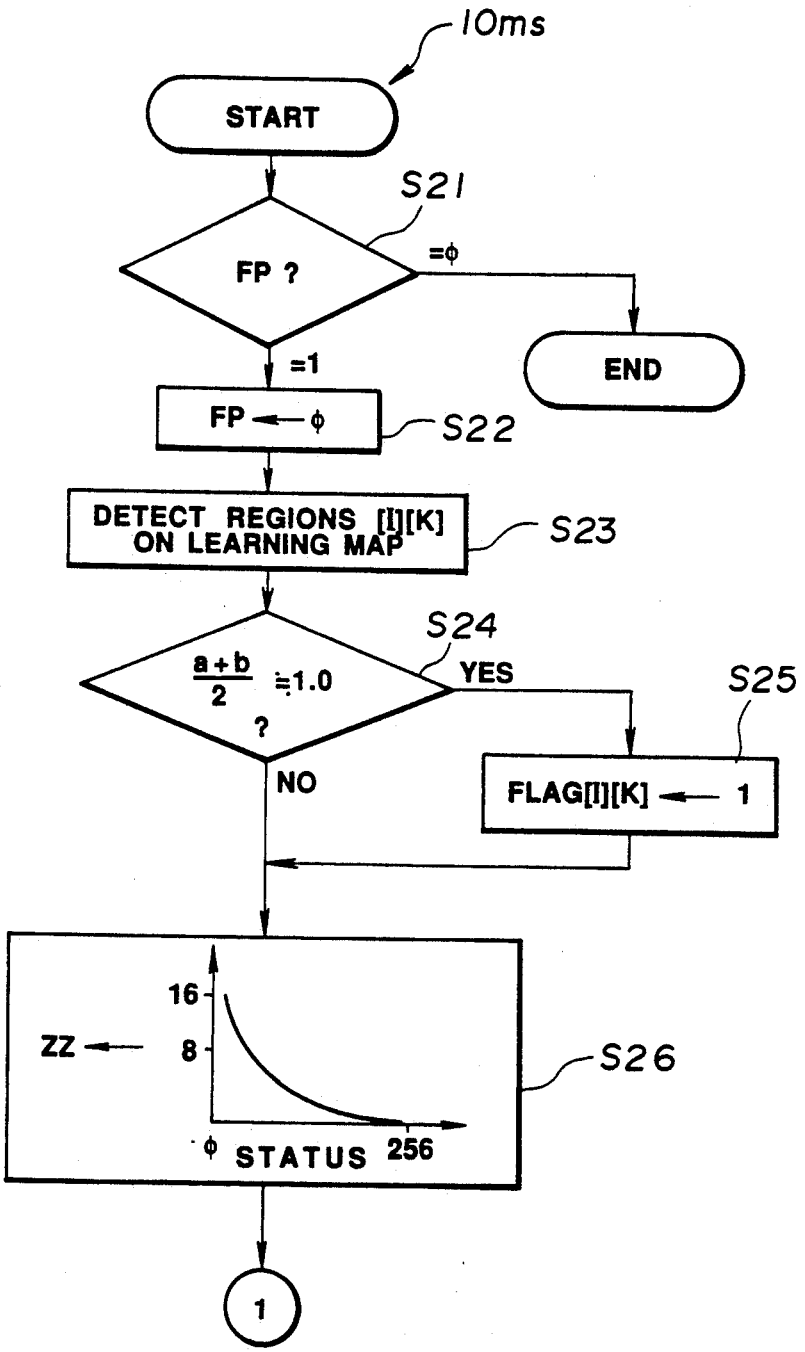
FIGS. 3(A) and 3(B) are integrally operational flowchart for explaining an air/fuel mixture ratio learning and controlling routine executed in the first preferred embodiment shown in FIG. 1.
Figure 3B:
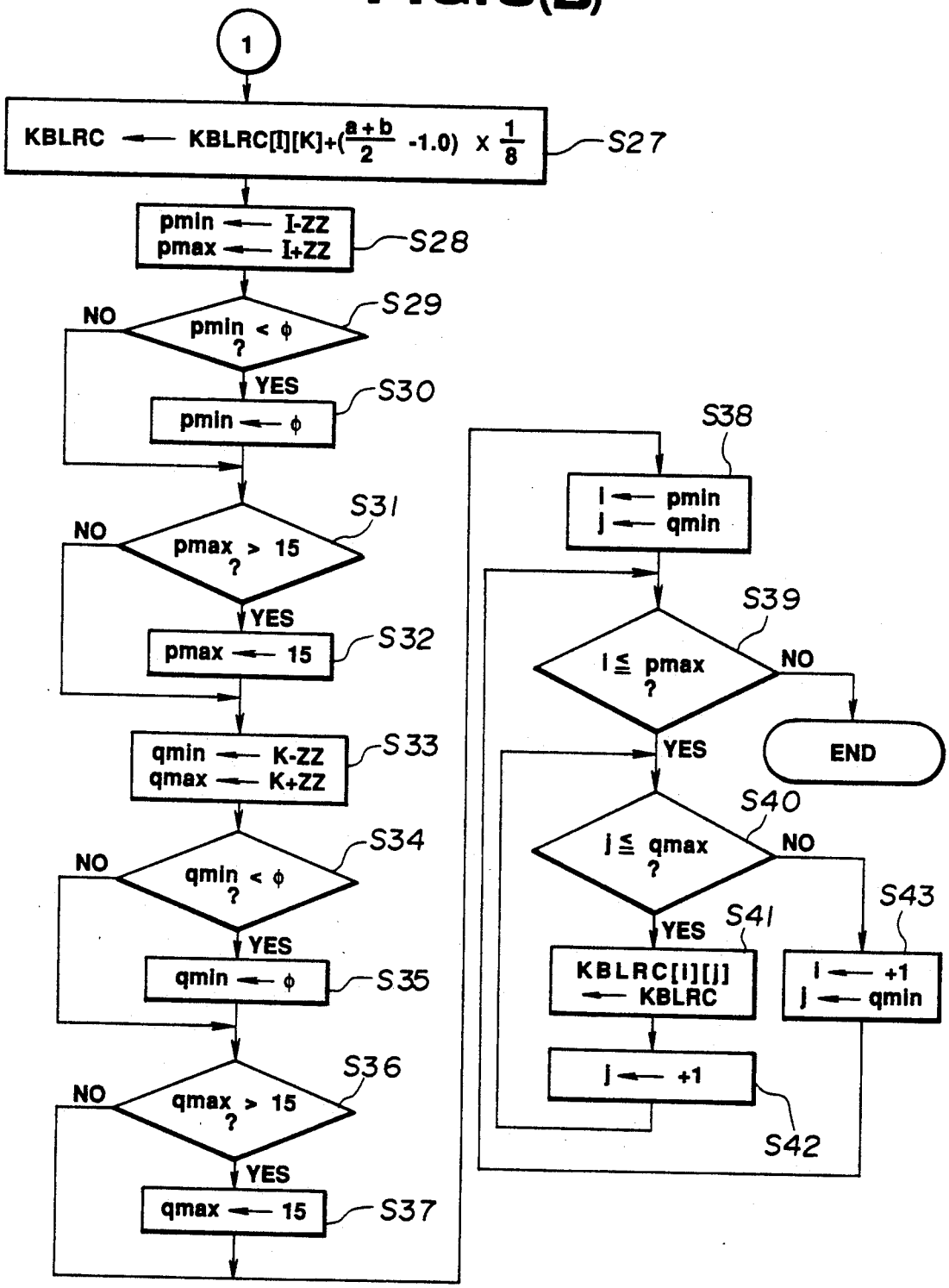

The program shown in the program flowchart of FIG. 2 is a program such that an air/fuel mixture ratio feedback correction coefficient LMD (air/fuel mixture ratio feedback correction value) to be multiplied by a basic fuel injection quantity (basic fuel supply quantity) is set through a proportion-integration control. The program shown in FIG. 3 is executed for one revolution of the engine 1.

In a step S1, the CPU reads the output voltage signal from the oxygen sensor ($O_2$/S) 16 according to the oxygen concentration in the exhaust gas.

In a step S2, the CPU compares the voltage signal from the oxygen sensor 16 read in the step S1 with a slice level (for example, a value of the voltage, t.e., 500 mV) which is set to correspond to the stoichiometric air/fuel mixture ratio. When the CPU determines that the voltage signal from the oxygen sensor 16 is larger than the slice level which corresponds to the target (stoichiometric) air/fuel mixture ratio and the actual air/fuel mixture ratio is therefore rich, the routine goes to a step S3 in which the CPU determines whether the rich state determination of the actual A/F (air/fuel mixture) ratio is a first time.

When the CPU determines that this is the first time in the step S3, the routine goes to a step S4 in which the air/fuel mixture ratio feedback correction coefficient LMD previously set is set to a maximum value a (a←LMD).

In the step S5, the CPU executes such a calculation that a predetermined proportional constant P is subtracted from the previous correction coefficient LMD to reduce the correction coefficient LMD (LMD←LMD−P).

In a step S6, the CPU sets a flag FP to "1" to indicate that the CPU has executed the proportion-integration control for the correction coefficient LMD, i.e., the reverse of rich state of the A/F ratio to lean or lean to rich has occurred.

On the other hand, when the rich determination is not the first time, the routine goes to a step S7 in which a value as a result of multiplication of an integration constant I with a newest fuel injection quantity Ti is subtracted from the previous correction coefficient LMD to update the correction coefficient LMD (LMD←LMD−I×Ti).

When the CPU determines that the voltage signal from the oxygen sensor 16 is lower than the slice level and the actual air/fuel mixture ratio is lean with respect to the stoichiometric air/fuel mixture ratio in the step S2, the routine goes to a step S8 in which the CPU determines whether the lean determination is the first time. When this is the first time, the routine goes to a step S9 in which the correction coefficient LMD previously set is set to a minimum value b (b←LMD).

In a step S10, the CPU adds a proportional constant P to the correction coefficient LMD previously set to update the correction coefficient LMD so that an incremental correction of the fuel injection quantity Ti is achieved (LMD←LMD+P).

In a step S11, the CPU sets the flag FP to "1" to indicate that the proportion-integration control has been executed.

When, in the step S8, the lean determination is not the first time, the routine goes to a step S12 in which a value as the result of multiplication of the integration constant I by the newest fuel injection quantity Ti is added to the previous correction coefficient LMD so as to increase gradually the correction coefficient LMD (LMD←LMD+I×Ti).

When executing the proportion-integration control of the correction coefficient LMD at the first time of the rich/lean determination, various processings as will be described later are carried out relating to the air/fuel mixture ratio learning control.

In details, in a step S13 of FIG. 2, the CPU determines if an estimation learning counter ZZ indicates zero. The estimation learning counter ZZ serves to indicate that when it indicates zero, the learnings of the learning correction coefficients KBLRC for all driving regions are all ended and it is set so as to become reduced as the number of regions for which the learnings of KBLRC are ended become increased on a learning map. The learning map stores the A/F ratio learning correction coefficient KBLRC which can be updated for each driving region. The detailed explanation of a setting control of the estimation learning correction coefficient KBLRC will be made later with reference to FIGS. 3 (A) and 3 (B).

It is noted that the end of learning in the first preferred embodiment means a state in which the target A/F ratio is actually derived without the correction by means of the A/F ratio feedback correction coefficient LMD, i.e., means that the CPU has determined that the learning correction coefficient for the corresponding driving region has already been learned when the air/fuel mixture feedback correction coefficient LMD is substantially coincident with the target convergence value (=1.0).

It is further noted that the learning map, in the first preferred embodiment, serves to store and update the learning correction coefficients KBLRC for the respectively divided driving regions (initial values are 1.0), the whole driving region of the engine 1 being divided into 18×16, i.e., 256 regions on the basis of the basic fuel injection quantity Tp and engine revolution speed N.

Referring to FIG. 2, when zero is set in ZZ in the step S13, the routine goes to a step S14 in which the CPU determines whether the region on the learning map in which the previous proportion-integration control is carried out is the same as the present region. If No, i.e., the driving region is changed in the step S14, the routine goes to a step S15 in which the CPU sets a stress Δ stress indicating a magnitude of inappropriateness as a result of learning on the basis of an absolute value of a deviation between an average value of the maximum value a and minimum value b set in the steps S4 and S9.

That is to say, since the CPU has determined that the learnings have substantially ended at all driving regions in the step S13, the correction coefficient LMD should be stable in the vicinity to the substantially target convergence value (=1.0) even through the corresponding driving region is changed provided that the learnings are accurately carried out. As the deviation with respect to the target convergence value is large, the CPU can estimate that a difference between the learning result and requested correction level is present.

Therefore, in the step S15, as the average value of the correction coefficient LMD has the larger deviation to the target convergence value, the above-described Δ stress is set to a larger value so that the increase in the Δ stress indicates the increase in the magnitude of inappropriateness of the learning result.

It is noted that Δ stress set in the step S15 is added to an accumulated value ⌈stress⌋ previously set in the next step S18. The result of addition is newly set to ⌈stress⌋ so that Δ⌊stress⌋ is accumulated for each proportion-integration control of the correction coefficient LMD.

Hence, for example, in a case where the basic air/fuel mixture ratio due to deteriorations or aging effects in the fuel injection valve and/or airflow meter 13 is entirely fluctuated and the correction by means of the A/F ratio feedback correction coefficient LMD is additively needed since only the correction by means of the learned learning correction coefficient KBLRC cannot achieve the target air/fuel mixture ratio, a relatively large Δ stress is set whenever the change in the driving region occurs in the learning map. Consequently, as the largely set Δ stress is sequentially accumulated to the ⌈stress⌋, the ⌈stress⌋ is rapidly increased. When the ⌈stress⌋ exceeds a predetermined level as will be described later, the CPU determines that the result of learning is inappropriate and the air/fuel mixture ratio learning is again started.

The series of programs shown in FIGS. 3 (A) and 3 (B) are integrally air/fuel mixture ratio learning program to update the learning correction coefficient KBLRC for the respective driving regions and are executed for a predetermined minute time (for example, 10 mS).

In a step S21, the CPU determines to which state the flag FF is set.

The flag FP is set to 1 when the proportion-integration control for the correction coefficient LMD is carried out in the flowchart of FIG. 2.

When the flag FP is set to zero, the program shown in FIGS. 3 (A) and 3 (B) is directly ended. When the flag FP is set to "1" in the step S21, the flag FP is reset to zero in a step S22 and the processing after the step S23 is advanced related to the air/fuel mixture ratio learning. Hence, the learning of the air/fuel mixture ratio as will be described later is executed whenever the proportion-integration control of the correction coefficient LMD is executed (whenever the reverse of rich or lean in the air/fuel mixture ratio occurs).

In a step S23, the driving region on the learning map which corresponds to the present engine driving condition is specified as a lattice position [I] and [K] on the basis of the newestly calculated basic fuel injection quantity Tp and engine revolution speed N.

In the next step S24, the CPU determines whether the average value (a+b)/2 of the correction coefficient LMD is substantially 1.0.

When the average value of the correction coefficient LMD is substantially 1.0 ((a+b)/2≒1.0) in the step S24, it is now in the state where the target A/F ratio is approximately obtained only by means of only learning correction coefficient KBLRC. Hence, the CPU can estimate that the learning correction coefficient KBLRC which is in the driving region of the learning map corresponding the present engine driving condition of Tp and N is appropriate. At this time, the routine goes to a step S25.

In the step S25, a learned flag Flag [I] [K] corresponding to the driving region indicated by the lattice position [I] [K] are set to "1" so that the driving region for which the learned flag Flag [I] [K] is set is determined to be a learned region.

In a step S26, the estimation learning counter ZZ described above is set on the basis of a number of the learned regions indicating counter Status from among the 256 regions on the learning map detected on the basis of the learned flag Flag [I] [K]. The estimation learning counter ZZ is reduced and set as the number of learned regions indicated by the counter Status becomes greater. In a case where the learned number of regions indicated by the counter Status is approximately the maximum number, i.e., 256, the number of learned regions indicating counter is set to zero (refer to the steps S13 and S26).

The estimation learning counter ZZ described above serves as a parameter to determine the number of other regions which are in the vicinity to the engine operating condition and to which the learning correction coefficient KBLRC for the corresponding driving region is directly applicable when the learning correction coefficient KBLRC for the corresponding one of the 256 regions on the learning map is updated.

When the estimation learning counter ZZ is zero, only the KBLRC for the corresponding driving region is learned.

However, according to the increase in the estimation learning counter ZZ, the number of other regions for which the learning correction coefficients KBLRC are once updated are increased. That is to say, as the increase in the number of learned regions, a range of the driving regions for which the KBLRC are once learned is gradually narrowed as appreciated from the step S26 of FIG. 3 (A).

Various processings after a step S27 are carried out related to the air/fuel mixture ratio according to the content of the estimation learning counter ZZ as shown in FIG. 3 (B).

In the step S27, a predetermined rate (in the first preferred embodiment, $\frac{1}{8}$) on a deviation of the average LMD with respect to the target convergence value (=1.0) for the average value of the correction coefficient LMD is added to the learning correction coefficient KBLRC [I] [K] (stored corresponding to one of the driving regions from among 256 regions on the learning map) and the result of addition is set as a new learning correction coefficient KBLRC (KBLRC←KBLRC [I] [K]+((a+b)/2−1.

In the next step S28, a value as the result of addition of the estimation learning counter ZZ to [I] indicating the corresponding position on the 16 lattice positions of the learning map divided according to the basic fuel injection quantity Tp is set to $P_{max}$ indicating a maximum position of a lattice position range in which the learnings for the KBLRC are once carried out on the lattice (matrix) divided according to the basic fuel injection quantity Tp ($P_{max}$←[I]+ZZ). In addition to this, in the step S28, a value as a result of subtraction of the estimation learning counter ZZ from the lattice position [I] is set to $P_{min}$ indicating a minimum position of the lattice range once learned on the lattice divided according to the basic fuel injection quantity Tp ($p_{min}$←[I]−ZZ).

That is to say, $p_{min}$~$P_{max}$ including the lattice position [I] serves as a range in which the learning for KBLRC are, at this time, once carried out on the lattice range divided according to the basic fuel injection quantity Tp.

Then, in steps S29 to S32, if $p_{min}$ and $p_{max}$ set in the step S28 are set in the step S28 exceeding a settable range from 0 to 15 (16 lattice points), the CPU executes a limitation processing of such $p_{min}$, $p_{max}$ as to be limited to zero which is an allowable minimum value or to 15 which is an allowable maximum value.

Similarly, in a step S33, the driving region to be learned on the lattice points divided according to the engine revolution speed N is set as $q_{min}$(←K−ZZ)~$q_{max}$(←K+ZZ).

In steps S34 through S37, the settings of the learning regions $q_{max}$~$q_{max}$ are limited within the set range from 0 through 15 in the same way as in the case of $p_{max}$, $p_{min}$.

$p_{min}$ and $q_{max}$ indicating least lattice numbers from among the learning range set as described above are set in respective counters 1, and j in a step S38.

In a step S39, the CPU determines whether the $p_{min}$ initially set counter i is below a maximum value $p_{max}$. When it is below $p_{max}$, the routine goes to a step S40.

In the step S40, the CPU determines whether the $q_{min}$ initially set counter j is below $q_{max}$.

When the CPU determines that the counter j is below $q_{max}$, the routine goes to a step S41 in which the learning correction coefficients KBLRC corresponding to the region position indicated by [i] [j] are rewritten (updated) as learning correction coefficients KBLRC as a value corresponding to the region in the step S27.

In the next step S42, the counter j is incremented by one and the routine returns again to the step S40.

Until the counter j exceeds $q_{max}$ in the step S40, the routine goes to a step S41 in which the same learning correction coefficient KBLRC at the region position indicated according to [i] [j] is set. This series of steps are repeated until i=$p_{max}$ of the step S39.

In a step S40, when the counter j is determined to exceed $q_{max}$, the routine goes to a step S43 in which the counter i is incremented by one and the counter j is reset to $q_{min}$ and the routine goes to a step S39.

Until the CPU determines that the counter i exceeds $p_{max}$ in the step S39, the counter j is varied from $q_{min}$ to $q_{max}$ with the counter i fixed and the same learning correction coefficient KBLRC is set at the region position indicated by [i] [j] and this processing is repeated.

During 256 regions on the learning maps, the same learning correction coefficient KBLRC which corresponds to the driving regions [I] [K] is set to the respective other driving regions (other driving regions approximate to the driving condition in the corresponding driving region) of [$p_{min}$] [$q_{min}$]~[$p_{max}$] [$q_{max}$] including the driving regions [I] [K]. When the number of learned regions is less in which the estimation learning counter ZZ is relatively largely set, the same learning correction coefficient KBLRC over the wide range including the regions [I] [K] is applied and a favorable learning convergence is achieved. As the learning range is narrowed as the estimation learning counter ZZ becomes reduced with the increase in the learned regions. Finally, 256 regions divided on the learning maps are individually learned.

Hence, in a structure having only the learning map whose entire driving region is finely (closely) divided into the narrow driving regions, convergence characteristic of learning and learning accuracy can be compatible in the first preferred embodiment so that the memory capacity can be saved as compared with the learning having the plurality of learning maps, the width of units of driving regions being different in which the learned correction coefficients KBLRC are respectively stored.

Figure 4:
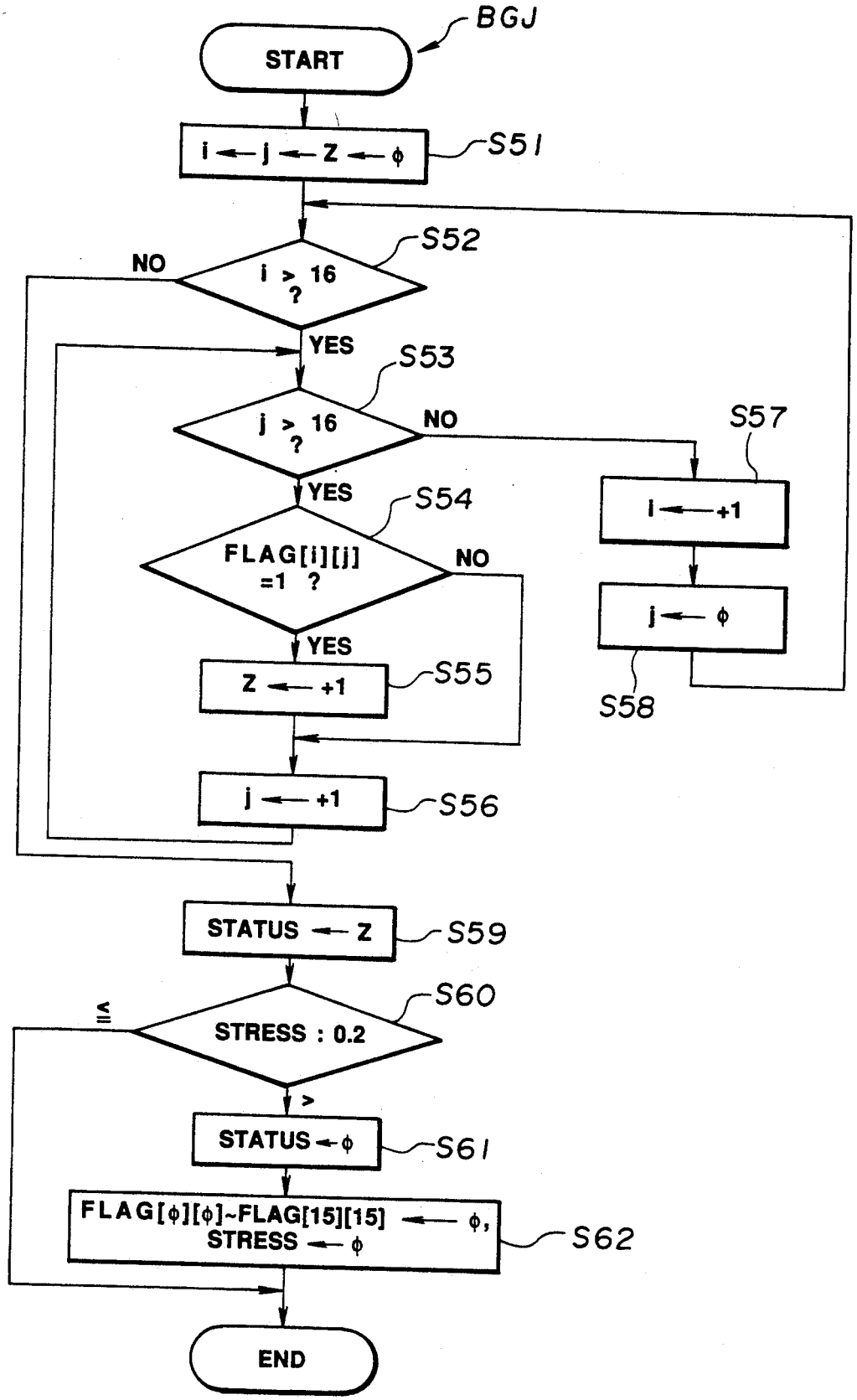
FIG. 4 is an operational flowchart for explaining a detection control routine of a number of driving regions in which the learning is carried out executed in the first preferred embodiment shown in FIG. 1.

FIG. 4 shows a program flowchart in which the learned driving region(s) on the learning map where the whole driving region is divided into the 256 driving regions is detected on the basis of the learned flag Flag [I] [K] registered for each driving region and the number of learned driving regions is counted. FIG. 4 is executed as a background job (BJG).

First, the lattice number counters i and j to individually indicate the 256 regions are respectively reset to zero in a step S51.

A counter Z to count the number of learned regions is reset to zero in the step S51.

In steps S52 through S58, the counter i is fixed to zero and the counter j counts up from zero to 15. Then, when the learned flag Flag which corresponds to the region indicated by [i] [j] indicates 1, the processing in which the counter Z is incremented by one is repeated. The contents of the learned flag Flag for all 256 regions are determined so that the number of the learned driving regions (1 is set to the learned flag Flag) is set into the counter Z.

Then, in a step S59, the value of the counter Z is set to the number of learned regions indicating counter Status. The estimation learning counter ZZ is, thereby, set in the step S26 of the flowchart shown in FIG. 3 (A).

In the next step S60, the CPU determines whether the contents of [stress] updated for each proportion-integration control of the correction coefficient LMD in the flowchart of FIG. 3 (A) exceeds a predetermined level (in the flowchart of FIG. 4, the value is 0.2). Although the [stress] described above is learned over all regions of the learning maps, the change in the basic air/fuel mixture ratio gives an inappropriateness of the result of learning. When the driving regions are changed, to compensate for the level difference between required correction level and learned correction coefficient KBLRC, a necessity to largely vary the correction coefficient LMD occurs so as to increase the correction coefficient LMD for each change in the driving regions. Hence, in a case where the [stress] exceeds a predetermined level, the result of learned is predicted which does not correspond to the actual basic air/fuel mixture ratio.

Then, when the CPU determines that the [stress] exceeds the predetermined level, the CPU sets the number of the learned regions Status to zero in the step S61 so that the number of regions in which the learned correction coefficients KBLRC are rewritten together with the regions on the learning maps becomes maximum. On the other hand, the learned flags Flag [0] [0]~[15] [15] for the respective driving regions in which 1 is set indicating the learned regions are reset to zero and the learning over a wide range of driving regions for the KBLRC including the corresponding driving region to be learned once is initially carried out.

Hence, when the basic air/fuel mixture ratio is changed and result of learning becomes inappropriate, the relearning as the wide driving regions as a unit can speedily be advanced. Then, the reduction of controllability for the air/fuel mixture ratio at the abrupt change in the basic air/fuel mixture ratio can be suppressed at minimum. As the learning is advanced and the number of learned regions is increased, the learning region becomes narrowed (the number of regions learned together with the corresponding regions become reduced) so that the correction in answer to the correction request for each driving condition can again be carried out. In this way, the air/fuel mixture ratio learning for the driving regions basically and closely divided is carried out and a faster learning can be converged during an abrupt change in the basic air/fuel mixture ratio.

In addition, in a step S62, a zero reset for the [stress] is carried out and the relearning to be carried out as described above is converged at all regions. Thereafter, the inappropriateness of the result of learning is accumulated into the above-described [stress].

Figure 5:
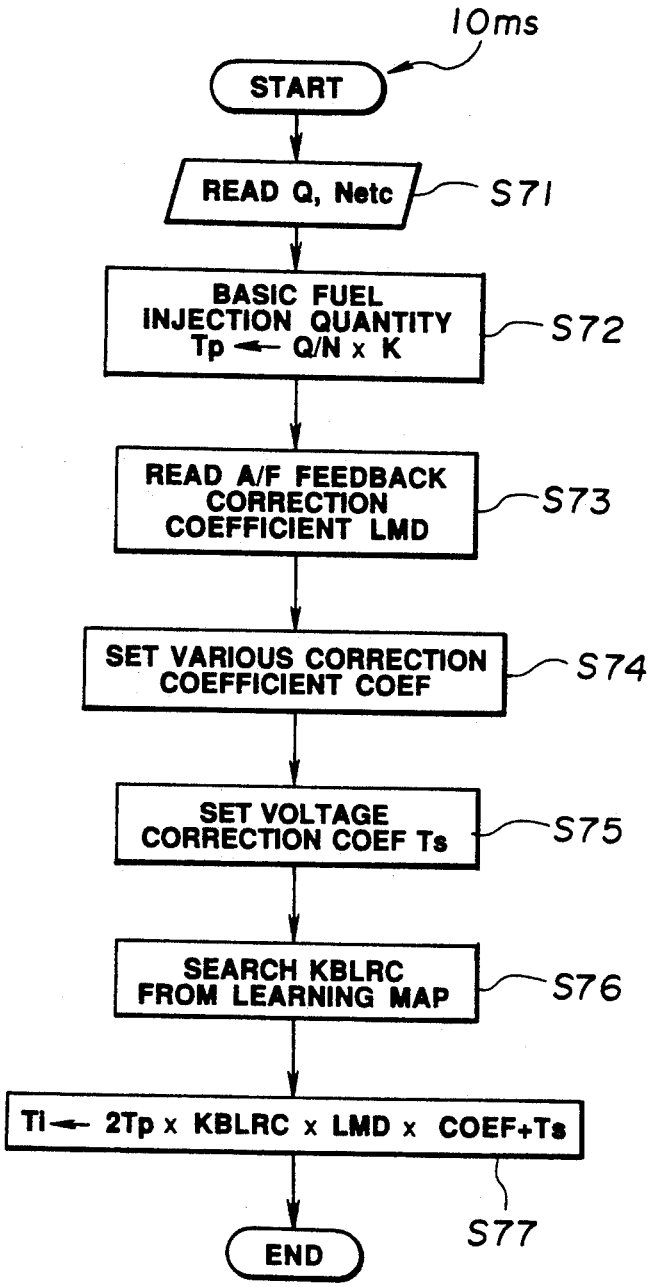
FIG. 5 is an operational flowchart for explaining a set control routine of a fuel injection quantity executed in the first preferred embodiment shown in FIG. 1.

The program shown in the flowchart of FIG. 5 is a set program of the fuel injection quantity and is executed whenever a predetermined minute time (for example, 10 ms) is passed.

In a step S71, the CPU reads the intake air quantity Q detected by means of an airflow meter 13 and an engine speed N calculated on the basis of a signal derived from a crank angle sensor 14.

In a step S72, the CPU calculates a basic fuel injection quantity Tp ($\leftarrow Q/N \times K$: K denotes a constant) on the basis of the intake air quantity Q and engine revolution speed N.

In a step S73, the CPU reads the air/fuel mixture ratio feedback correction coefficient LMD which receives the proportion-integration control.

In a step S74, the CPU sets various correction coefficients including a basic correction coefficient based on a coolant temperature detected from a coolant temperature sensor 15.

In a step S75, the CPU sets a voltage correction quantity Ts to correct an effective or valid opening time duration of the fuel injection valves 6 due to the change in battery voltage.

In a step S76, the CPU specifies a particular driving region on the learning map according to the basic fuel injection quantity Tp and engine revolution speed N calculated in the step S72, reading the learned correction coefficient KBLRC stored corresponding to the driving regions.

In a step S77, the CPU calculates a final fuel injection quantity Ti ($\leftarrow 2Tp \times KBLRC \times LMD \times COEF + Ts$), correcting the basic fuel injection quantity Tp in accordance with the air/fuel mixture ratio feedback correction coefficient LMD, various correction coefficients COEF, voltage correction Ts, and learned correction coefficient KBLRC.

The control unit 12 outputs the drive pulse signal corresponding to the fuel injection quantity Ti newestly set in the step S77 to the fuel injection valves 8 to execute the supply of fuel injected to the engine 1.

It is noted that although the driving regions are divided by 256 regions on the basis of the basic fuel injection quantity Tp and engine revolution speed N in the first preferred embodiment and the learning correction coefficients KBLRC are learned for the respective driving regions, the number of divided regions and the driving condition are not limited to those in the first preferred embodiment. In addition, since the basic fuel injection quantity Tp is set not only on the basis of the intake air quantity Q and engine revolution speed N but also may alternatively be set on the basis of, e.g., intake air pressure and engine revolution speed N.

Second preferred embodiment

Figure 6A:
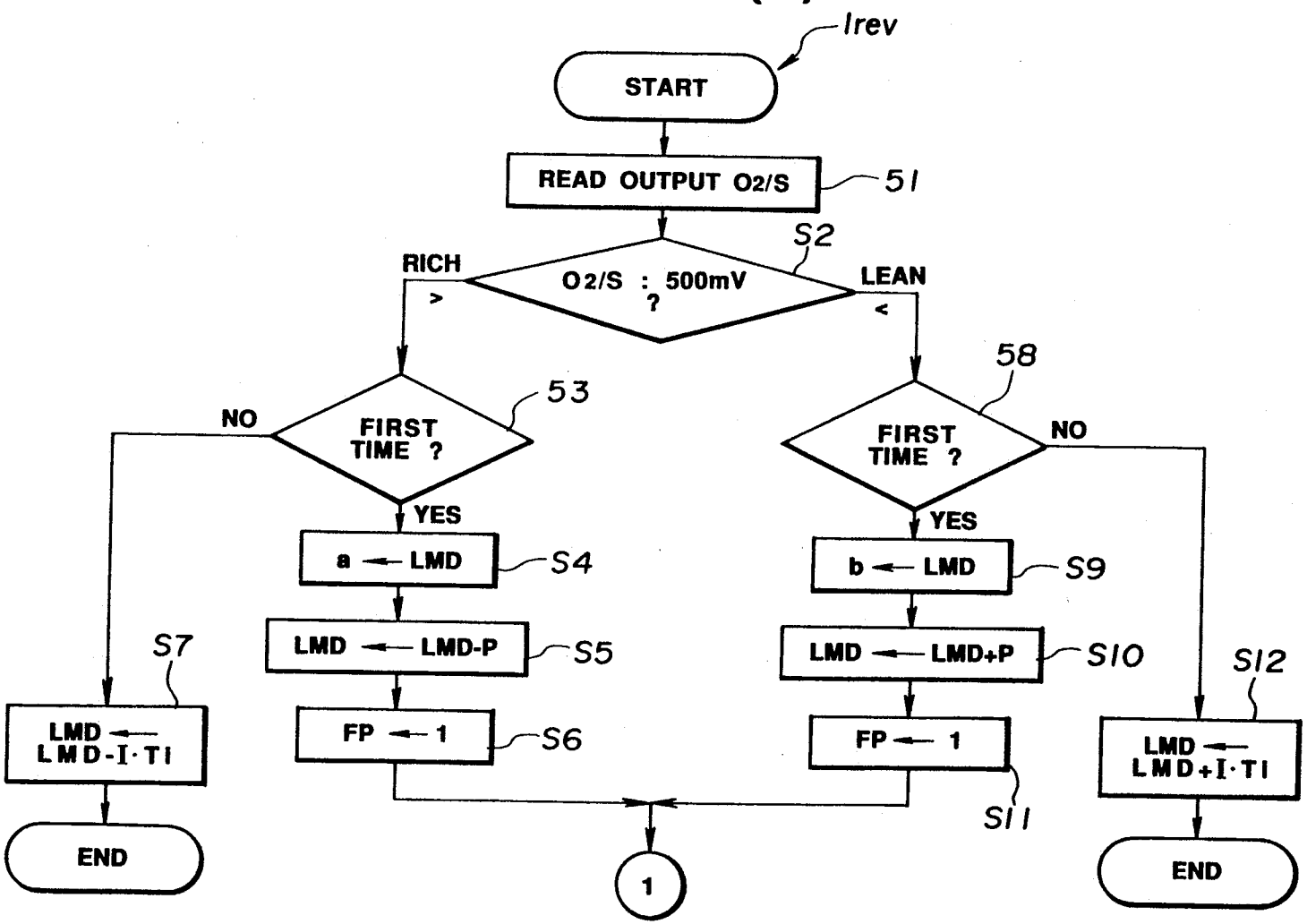
FIGS. 6(A) and 6(B) are integrally an operational flowchart for explaining the air/fuel mixture ratio learning and controlling routine in a second preferred embodiment of the air/fuel mixture ratio learning and controlling system according to the present invention.
Figure 6B:
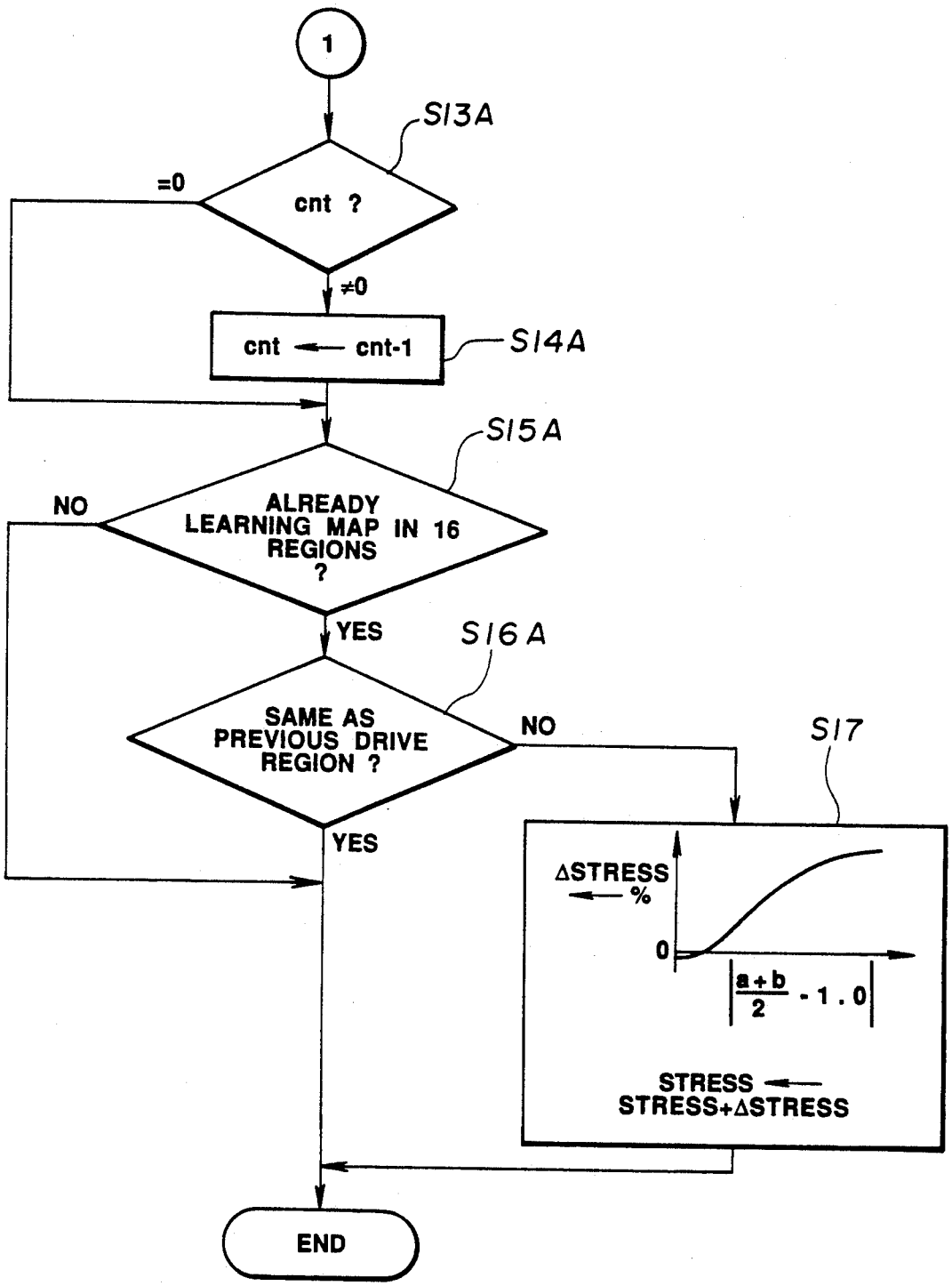
Figure 7A:
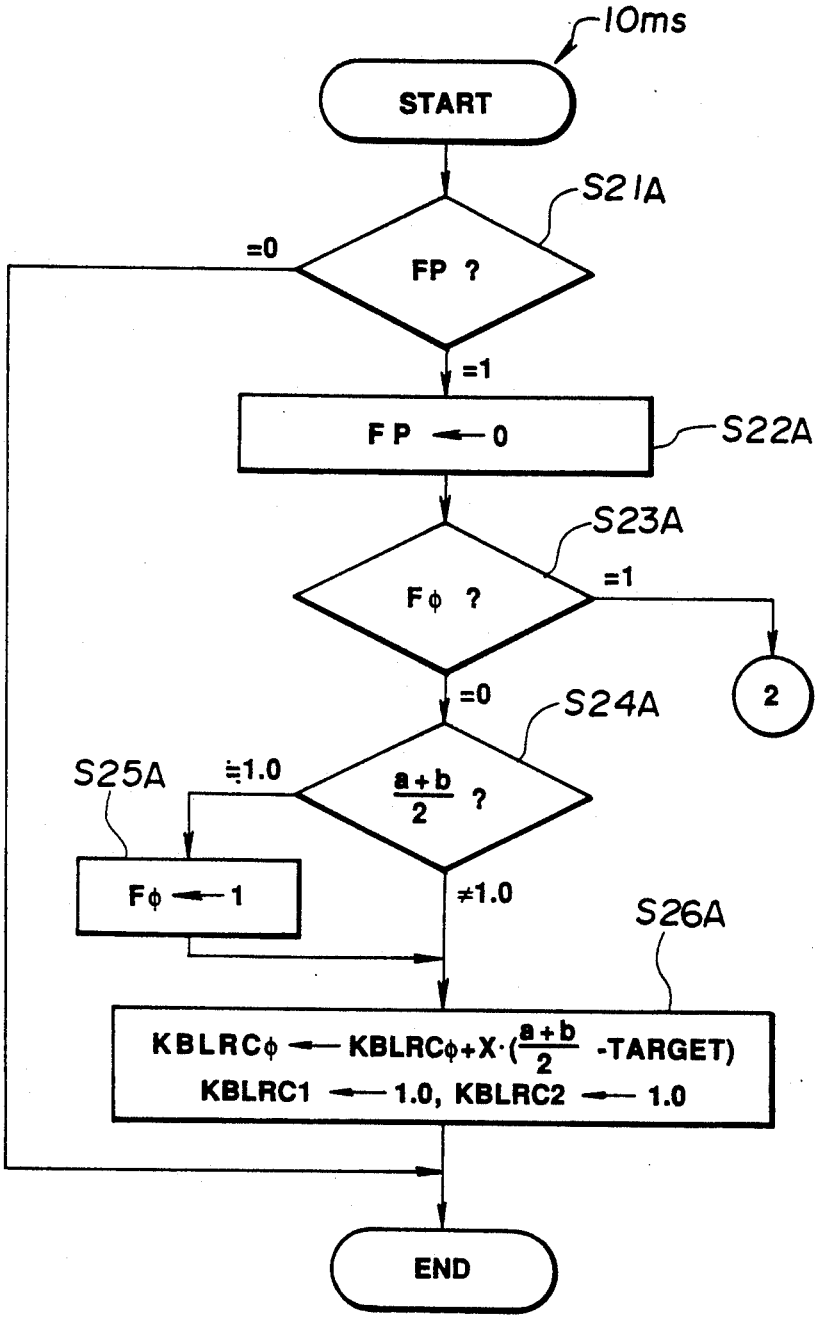
FIGS. 7(A), 7(B), 7(C), and 7(D) are integrally operational flowcharts for explaining the air/fuel mixture ratio learning and controlling system in the second preferred embodiment according to the present invention.
Figure 7B:
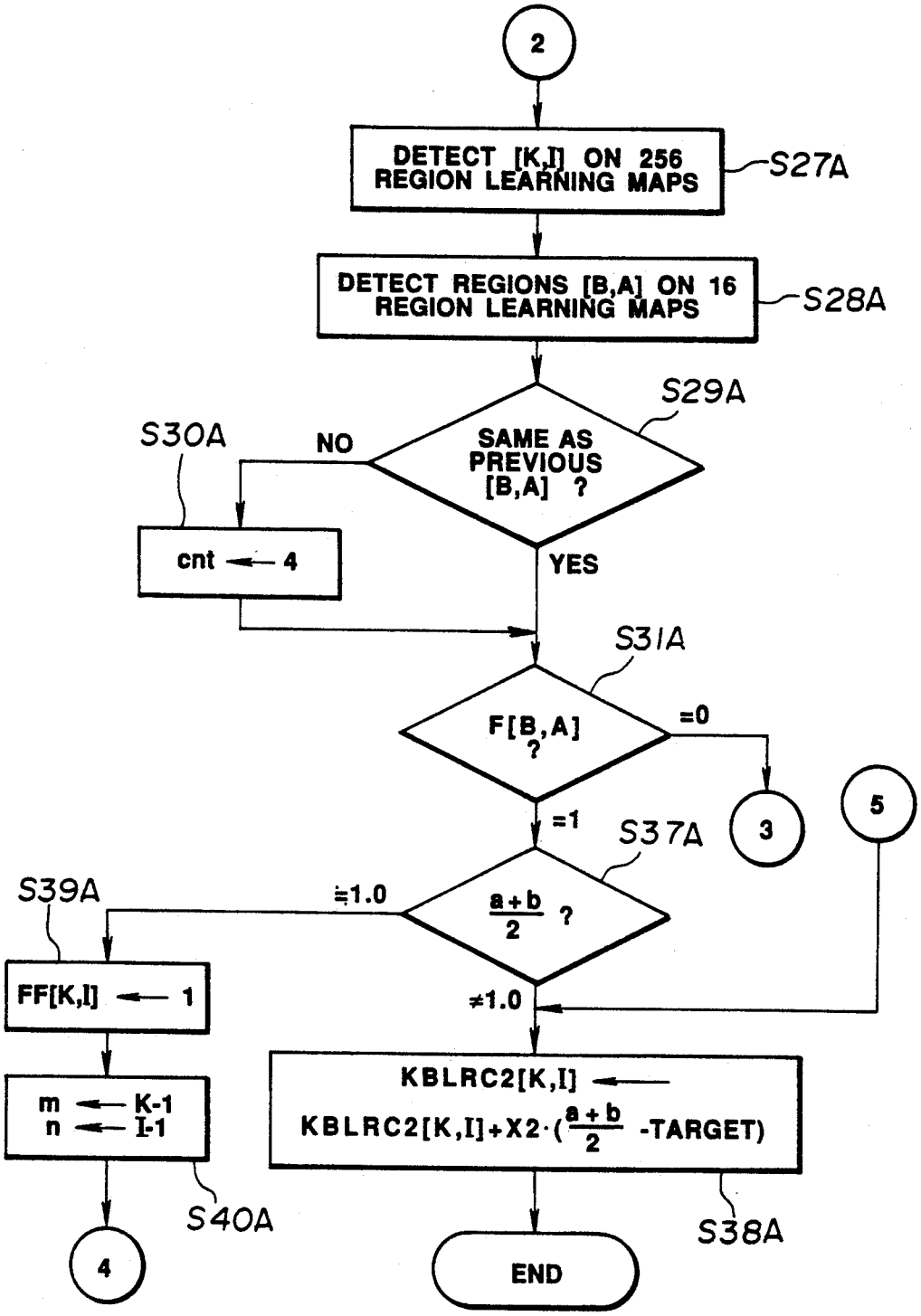
Figure 7C:
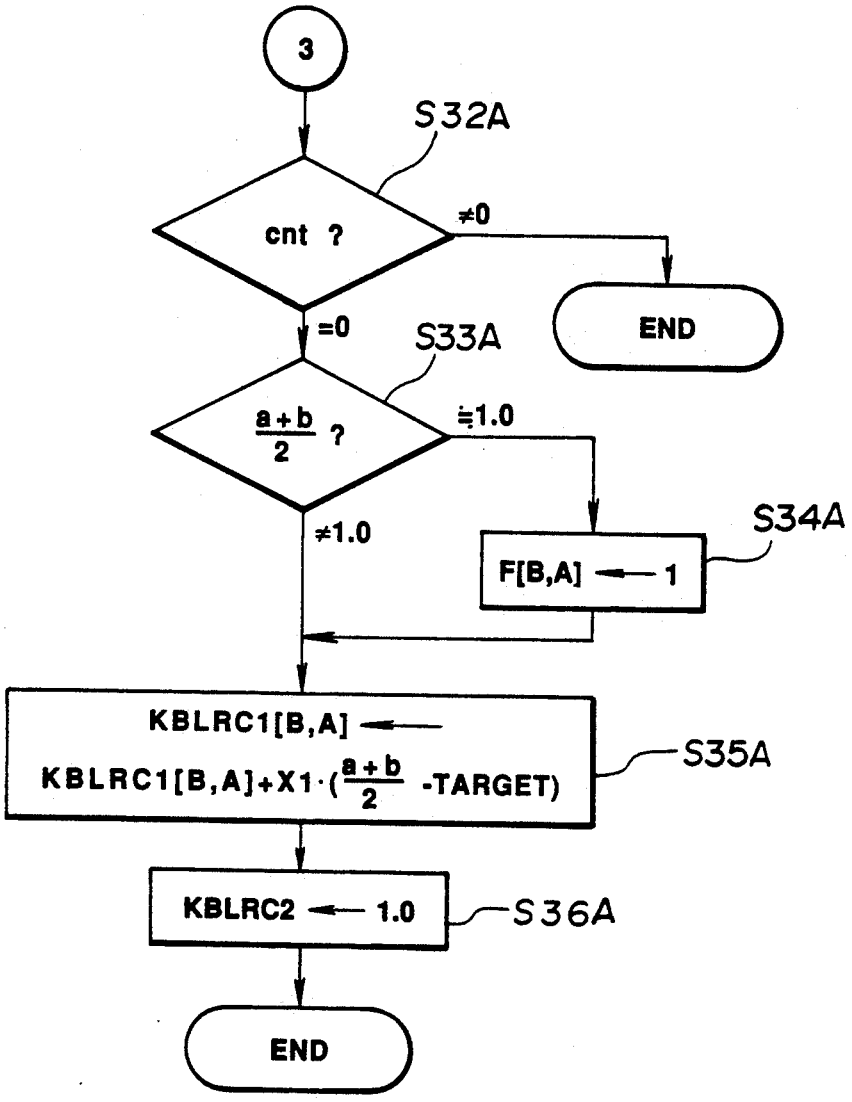
Figure 7D:
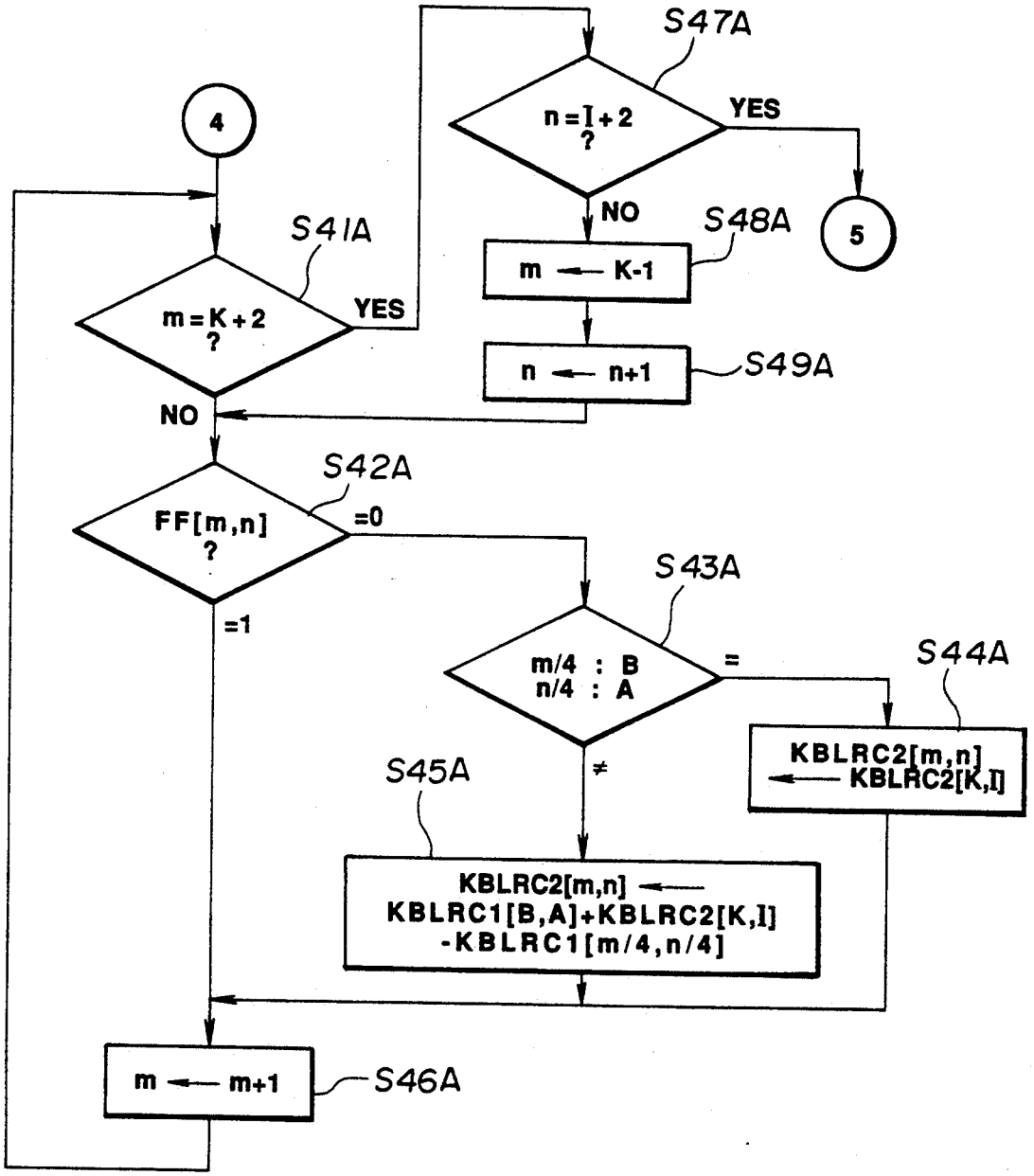

FIGS. 6 (A) and 6 (B) show an integrally flowchart for setting the air/fuel mixture ratio feedback correction coefficient LMD (air/fuel mixture ratio feedback correction value) by which the basic fuel injection quantity Tp is multiplied through the proportion-integration control.

The integrated flowchart shown in FIGS. 6 (A) and 6 (B) is executed for one revolution (1 rev) of the engine 1 and in a second preferred embodiment of the air/fuel mixture ratio learning and controlling system according to the present invention.

It is noted that the structure of the second preferred embodiment is the same as in the first preferred embodiment shown in FIG. 1.

Since the steps S1 through S12 of FIG. 6 (A) are the same as those shown in FIG. 2, the explanations thereof are omitted here.

Figure 12:
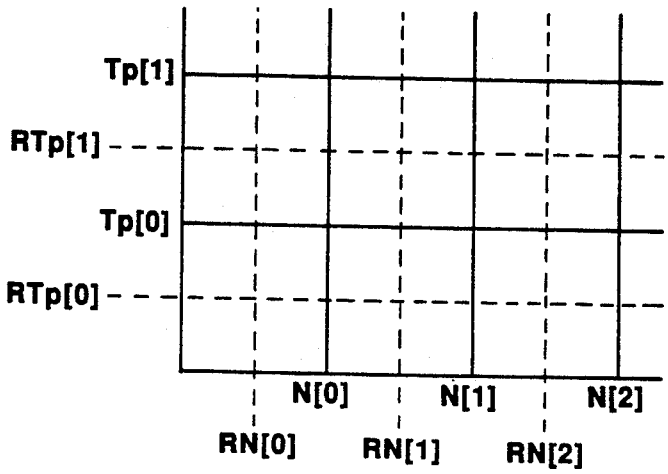
FIG. 12 is a virtually explanatory view for explaining a series of situations in which the driving conditions are set in the case of an interpolation calculation executed in the second preferred embodiment.

In the second preferred embodiment, as appreciated from FIG. 12, the whole driving region is divided into 16 units of driving regions and a 1B region learning map is prepared in which first learning correction coefficients KBLRC1 for the 16 units of the driving regions are rewritably stored. In addition, the whole region is subdivided into 256 unit driving regions and a 256 region learning map is prepared in which second learning correction coefficients KBLRC2 are rewritably stored. Furthermore, a third learning correction coefficient KBLRC0 is additively set which is applicable to the whole engine driving condition with no division of the driving regions.

In a step S13A after the proportion-integration control for the air/fuel mixture ratio feedback correction coefficient LMD, the CPU determines by which a count value cnt is indicated. The count value cnt indicates so as to be determined by means of the CPU whether the present driving condition is in a stably stayed state in one of 16 driving regions of the 16 region learning map.

In the series of program flowcharts shown in FIGS. 7 (A) through 7 (D) as will be described later, when the driving region of the 16 region learning map in which the present driving condition falls is changed for a predetermined minute time, a predetermined value (for example, four) is set to the count value cnt.

If the count value cnt is determined to be set to not zero in the step S13, the routine goes to a step S14 in which the count value cnt is decremented by one.

In a step S15A, the CPU determines whether almost all driving regions on the 16 region learning map have been learned or not on the basis of learned flags F [B, A] set for the respective driving regions as will be described later.

When almost 16 regions on the learning map have already been learned, the routine goes to a step S16A in which the CPU determines whether the driving region on the 256 region learning map is the same as the previous one. Then, only in a case where the change in the driving region occurs, the routine goes to a step S17.

In the step S17, the CPU refers to a map on the Δ Stress indicating a magnitude of inappropriateness of the learning value on the basis of the absolute value of the deviation of the average value (a+b)/2 of the newest correction coefficient LMD to the target convergence value Target (=1.0) so that the Δ Stress is set so as to increase according to the increase in the deviation of the correction coefficient LMD to the target convergence value Target. Then, the Δ Stress presently derived is added to a ⌈Stress⌋ in which the accumulated value of Δ Stress is set.

As will be described later, when the stress exceeds the predetermined value, the CPU determines that the learned air/fuel mixture ratio learning correction coefficients KBLRC are inappropriate and the learnings need to be restarted. That is to say, in a state in which the learnings are sufficiently advanced, the correction coefficient LMD should be settled substantially at the target convergence value Target even though the driving condition is varied. However, when the result of learning is inappropriate, the A/F ratio correction coefficient LMD is tried to be varied so as to cancel the inappropriateness of the learning. Thus, the CPU can determine the good result of learning according to the deviation of the correction coefficient LMD to the target convergence value Target. In addition, if the result of learning indicates the inappropriateness, the learning is restarted so as to achieve an appropriate result of learning.

FIGS. 7 (A) through 7 (D) show integrally program flowchart of the A/F ratio learning for respective driving regions. The program flowchart of FIG. 7 (A) is executed whenever the predetermined minute time (for example, 10 mS) is passed.

In a step S21A of FIG. 7 (A), the CPU determines the set state of the flag FP. When the flag FP indicates 1, the routine advances a step S22A in which the flag FP is reset to zero and the various types of processings by means of the program are carried out. If zero, the routine is ended.

When the flag FP is reset to zero in the step S22A, the routine goes to the next step S23A in which a flag FO indicating whether the third learned correction coefficient KBLRC0 (initial value 1.0) common to the whole driving region has been learned.

When the flag FO indicates zero and the third learning correction coefficient KBLRC0 has not been learned, the routine goes to a step S24A in which the CPU determines whether the average value between the maximum and minimum values a, b of the correction coefficient LMD (←(a+b)/2) is substantially 1.0 or not.

When (a+b)/2 indicates not substantially 1.0, the routine goes to a step S26A. The CPU calculates the following rewrite of the third learning correction coefficient as a new third learning correction coefficient.

KBLRC0←KBLRC0 (previous third correction coefficient)+X ((a+b)/2−Target), wherein X denotes a predetermined coefficient.

It is noted that, in the step S26A, the first learning correction coefficient KBLRC1 and second learning correction coefficient KBLRC2 stored respectively in the driving regions of the 16 region learning map and 256 region learning map are all reset to the initial value 1.0.

When, in the step S24, the CPU determines that (a+b)/2 is substantially 1.0, the CPU sets the bit 1 to the flag FO (FO←1) in the step S25A so that the CPU can determine that the learning of the learning correction coefficient KBLRC0 corresponding to the whole driving region has been carried out.

On the other hand, if the CPU determined that the flag FO indicates 1 in the step S23A, the air/fuel mixture ratio learnings for the respective driving regions divided in plural on the basis of the basic fuel injection quantity Tp and engine revolution speed N are carried out as described below.

First, in a step S27A, the CPU determines whether the present region [K, I] substantially corresponding to the present driving condition is determined on the basis of threshold values Tp [i], N[k] of the basic fuel injection quantity Tp and engine revolution speed N set to previously divide the whole driving region into 256 regions.

Figure 11A:
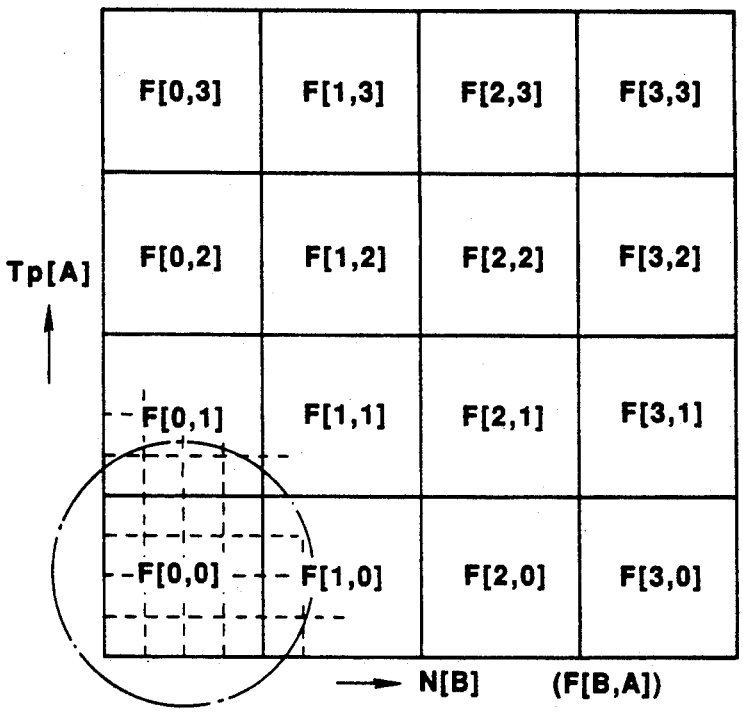
FIGS. 11(A) and 11(B) are virtually explanatory views for explaining a series of situations in which learning maps in the second preferred embodiment are set.
Figure 11B:
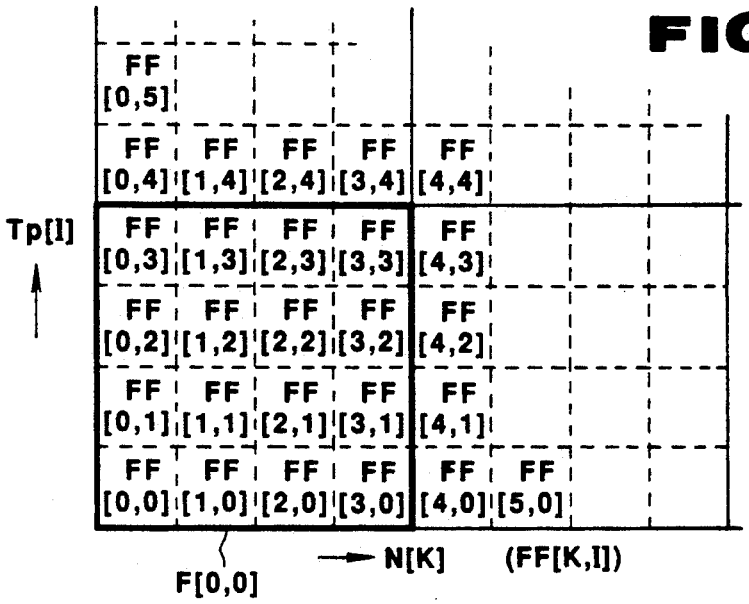

As shown in FIG. 11, K denotes a position of the corresponding region from among the 16 regions divided with regular intervals of the engine revolution speed N as a parameter and I denotes a position of the 16 regions divided with regular intervals of the basic fuel injection quantity Tp as a parameter.

In the next step S28, the CPU detects the corresponding region [B, A] on the 16 region learning map as the region on the 16 region learning map in which the corresponding region [K, I] is included.

In the next step S29, the CPU determines whether the corresponding region [B, A] on the 16 region learning map is the same as the previous one [B, A].

When the driving region on the 16 region learning map is changed (No in the step S32A), the routine advances to a step S30A in which the CPU sets a predetermined value (for example, 4) to the decrementally counted value of cnt in the step S14A.

In a step S31A, the CPU determines the flag F [B, A] indicating whether the learning in the region [B, A] at the 16 region learning map is ended. When the flag F [B, A] is zero and the learning at the region [B, A] is not ended, the routine goes to a step S32A of FIG. 7 (C).

In the step S32A, the CPU determines whether the count value cnt is zero or not. When the variation of the region is present in the 16 region learning map and the count value cnt is not zero, the program is ended. Only when the count value cnt is zero and the corresponding driving region [B, A] on the 16 region learning map is stable, the routine goes to a step S33A.

In a step S33A, the CPU determines the advance of the learning depending on whether the average value (a+b)/2 of maximum and minimum values a, b of the air/fuel mixture ratio feedback correction coefficient LMD which is sampled in the program shown in FIGS. 6 (A) and 6 (B), i.e., depending on whether a center value of the correction coefficient LMD is placed in the vicinity to the initial value (=1.0) which is the target convergence value Target.

When the CPU determines that the average value of the correction coefficient LMD is not substantially 1.0 and the learning is not ended, the routine goes to a step S35A. When the average value of the correction coefficient LMD is substantially 1.0 and the learning is ended, the routine goes to a step S34A in which 1 is set to the flag F [B, A] and the routine goes to a step S35A.

In the step S35A, the CPU calculates the following set operation so as to provide a new first learning correction coefficient KBLRC1:

$$KBLRC1[B,A] \leftarrow KBLRC1[B,A] + X1((a+b)/2 - Target)$$

During the learning of the region [B, A] on the 16 region learning map, the 16 region learning correction coefficients KBLRC2 included in the [B, A] region in the 256 region learning map are all reset to the initial value 1.0 in a step S36A.

On the other hand, when the CPU determines that the flag F [B, A] indicates 1, the routine goes to a step S37A in which the driving region [B, A] on the 16 region learning map is further transferred to the learning of 256 region learning map.

In a step S37A, the CPU determines whether (a+b)/2, the average value of the correction coefficient LMD is substantially coincident with 1.0 of the target convergence value Target.

When (a+b)/2 does not substantially equal to 1, 0 and the correction by means of the air/fuel mixture ratio LMD is required as in the unlearned state, the routine goes to a step S38A.

In the step S38A, the CPU calculates the following updating operation of the mapped data to provide a new second learning correction coefficient KBLRC2:

$$KBLRC2[K,I] \leftarrow KBLRC2[K,I] + X2[(a+b)/2 - Target)$$

On the other hand, if, in the step S37A, the CPU determines that (a+b)/2 which is the average value of the correction coefficient LMD is substantially coincident with 1.0 of the target convergence value Target, the routine goes to a step S39A in which the CPU sets 1 to the flag FF [K, I] so as to determine that the learning on the driving region [K, I] in which the present driving condition falls is ended on the 256 region learning map.

Then, in the series of processings in FIG. 7 (D) including a step S40A, the CPU executes the setting control over appropriate second learning correction coefficients KBLRC2 to the plurality of adjacent driving regions approximately corresponding engine driving condition. The plurality of driving regions on the same map are adjacent to the predetermined driving region [K, I] on the 256 region learning map for which the present learning is determined to be ended. These appropriate second learning correction coefficients KBLRC2 are estimated on the basis of the learning correction coefficient KBLRC2 at the corresponding region [K, I] for the respective adjacent driving regions approximate to the driving condition adjacent to the same map as the predetermined driving region [K, I] on the 256 region learning map determined that the present learning is ended.

In the step S40A, a value as the result of subtraction of I from K, I indicating the regions including the present driving condition at 256 region learning maps is set to m, n.

In the next step S41A of FIG. 7 (D), the CPU determines whether m=K+2.

Since no determination (negative acknowledgment) is carried out when advancing from the step S40A to the step S41A, the routine goes to a step S42A in which the CPU determines whether the learning of the driving regions on the 256 region learning map indicated by [m, n] is ended depending on whether the flag FF [m, n] indicates 1 or zero.

When the learning is not ended, the flag FF [m, n] indicating zero, the routine goes to a step S43A. In the step S43A, the region position [m, n] in the 256 region learning map is converted into the region position [m/4, n/4] on the 16 region learning map so as to specify a region in which the region [m, n] is included in the 16 region learning map. Then, the CPU determines whether the region [m, n] adjacent to [K, I] which is a corresponding region on the 256 region learning map is included in the same region [B, A] as [K, I] in the 16 region learning map.

That is to say, this is because [K, I] is a region included in [B, A] and an adjacent region of [K, I] is included in another region adjacent to [B, A] on the 16 region learning maps. When the corresponding region [K, I] and adjacent region [m, n] are included in the same [B, A] ([m/4, n/4]=[B, A]), the routine goes to a step S44A in which the learned correction coefficient KBLRC2 corresponding to [K, I] which is determined to be presently learned is stored directly as the learned value of the adjacent region [m, n].

On the other hand, when the CPU determines that the adjacent region [m, n] to the region [K, I] is included in the region different on the 16 region learning map ([m/4, n/4]=[B, A], the routine goes to a step S45A in which the learning correction coefficient KBLRC2 is stored in the adjacent region using the following equation:

$$KBLRC2[m,n] \leftarrow KBLRC1[B,A] + KBLRC1[K,I] - KBLRC1[m/4,n/4].$$

As described above, when KBLRC1 [m, n] is updated as anew KBLRC1, the routine goes to a step S46A in which the part m is counted up and the routine returns to the step S41A. Until m=K+2, the learned and unlearned are determined for each driving region.

When the CPU determines that m=K+2 as a result of one incremental processing of m in the step S46A, the routine goes to a step S47A and determines if n=I+2.

If n=I+2, m is again set to K−1 in a step S48A and n is incremented by one in the next step S49A, the routine goes to a step 42A.

In a step S47A, when n=I+2, the routine goes to the step S38A since all determining processings of 8 driving regions enclosed by [K, I] have been completed.

In the step S38A, the CPU carries out the learning and updating of the learning correction coefficient KBLRC2 in which the CPU determines that it is already learned at the present region [K, I].

As described above, after, in the first preferred embodiment, the learned correction coefficient KBLRC0 corresponding to all driving regions is learned, the learning for the respective driving regions on the 16 region learning map is carried out. Therefore, since the magnitude of the region stepwise learned from the larger driving region to the smaller driving region is narrowed and the learning is advanced, the convergence characteristic of the air/fuel mixture ratio can be secured due to the learning for the larger driving regions. Therefore, we can accurately correspond to the difference in the required correction value due to the difference in the driving condition.

Figure 8:
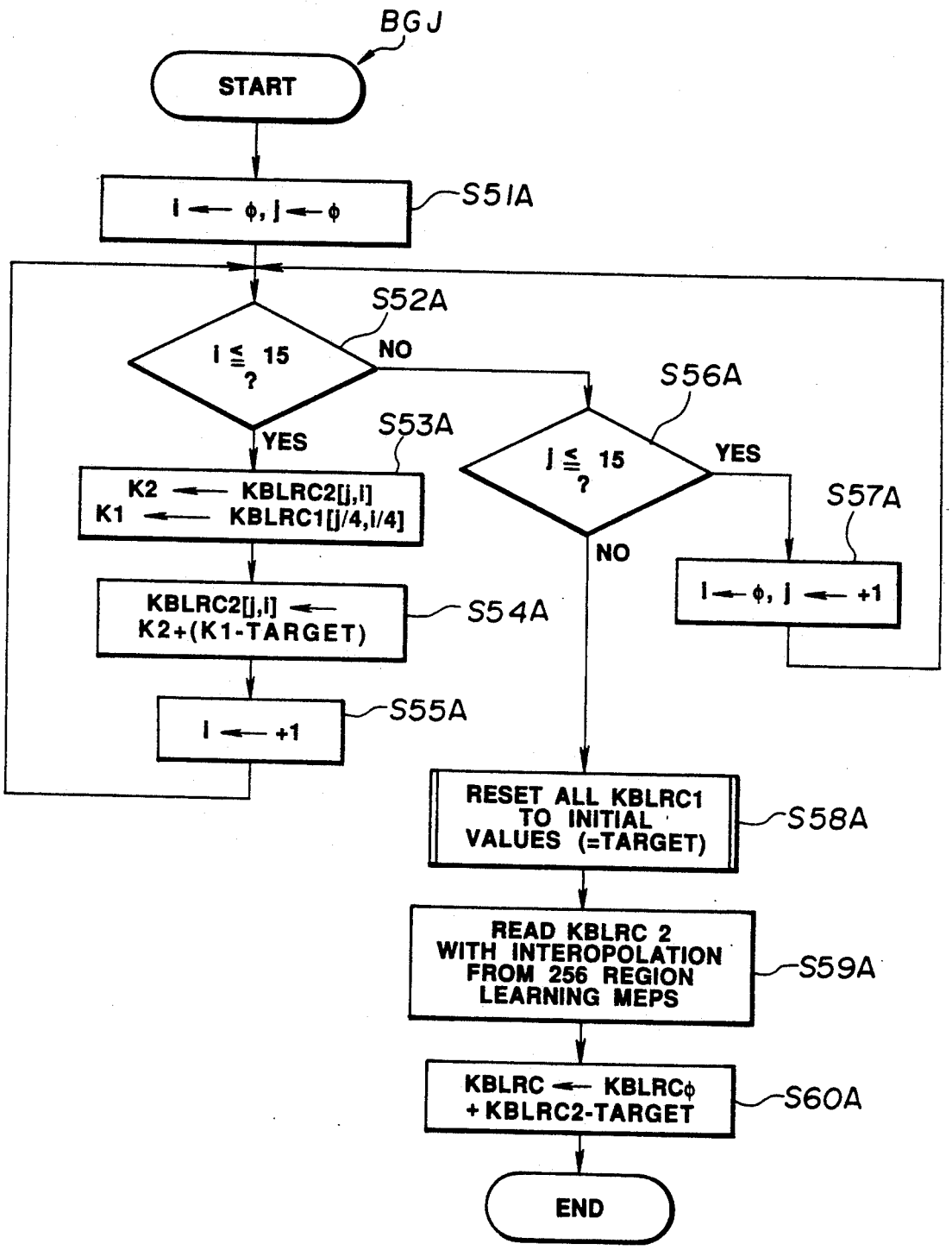
FIG. 8 is an operational flowchart for explaining a correction and read-out control routine for a result of learning in the second preferred embodiment.

The result of learning thus carried out receives corrections in accordance with the program flowchart shown in FIG. 8.

The contents of program processings shown in FIG. 8 will briefly be described below.

The deviation of the learning correction coefficient KBLRC1 to the target convergence value Target is added to the respective 16-region learning correction coefficients KBLRC2 included in the driving regions to which the learning correction coefficient KBLRC1 is applicable so that the correction loads for the learning correction coefficient KBLRC1 are transferred to the learning correction coefficient KBLRC2. After the transfer to the correction is carried out, all of the learning correction coefficients KBLRC1 are reset to the target convergence value Target so as to avoid a double air/fuel mixture ratio.

That is to say, since the result of learning carried out by 16 region learning map and by 256 region learning map is converged into the learning correction coefficient KBLRC2 for the respective 256 regions on the 256 region learning map.

Referring to FIG. 8, the flowchart functions as a background job.

In a step S51A, counters i, j to indicate the respective regions on the 256 region learning maps are reset to zero. In a step S52A, the CPU determines whether the counter i exceeds 15.

When the counter i is below 15, the routine goes to a step S53A in which K2 is set to the learning correction coefficient KBLRC2 [j, i] corresponding to the region on the 256 region learning map indicated by [j, i] and K1 is set to the learning correction coefficient KBLRC1 [j/4, i/4] corresponding to the region [j/4, i/4] on the 18 region learning map including [j, i].

In a step S54A, the updating of the learning correction coefficient KBLRC2 [j, i] is carried out in accordance with the following equation:

$$KBLRC2[j, i] \leftarrow K2 + (K1 - Target).$$

If the learning correction coefficient KBLRC2 [i, j] on the 256 region learning map is updated, the load on the correction by means of the learning correction coefficient KBLRC1 is transferred to the learning correction coefficient KBLRC2.

When the updating of the learning correction coefficient KBLRC2 is carried out in a step S54A, the routine goes to a step S55A in which the counter i is incremented by one and the routine returns to a step S52A. Then, when the counter i exceeds 15, the routine advances from a step S52A to a step S56A to determine whether the counter j exceeds 15.

Then, when the counter j is below 15, the counter i is reset to zero. Together with the counter j being counted up by one, the routine returns again to the step S52A. Then, the updating in the step S54A is carried out for all of the 256 regions.

Upon completion of the learning correction coefficient KBLRC2 on the 258 region learning map, when the CPU determines that, in the step S56A, the counter j exceeds 15, the load to the correction by means of the learning correction coefficient KBLRC1 is transferred to all learning correction coefficients KBLRC2. Therefore, to avoid the double corrections, the CPU resets the learned correction coefficient KBLRC1 respectively corresponding to 16 regions in a step S58A to the target convergence value Target (=1.0), i.e., the initial value.

The correction loads by means of the learning correction coefficient KBLRC1 is transferred to the learning correction coefficient KBLRC2 and the processing in which the learned correction coefficient KBLRC1 is reset to all initial values is ended.

When the result of learning for each driving region according to each learning map is carried out and is retrieved into the learning correction coefficient KBLRC2 on the 256 region learning map, the routine goes to the next step S59A. In the next step S59A, a linear interpolation is used to read the learning correction coefficient KBLRC2 corresponding to the instantaneous driving condition.

The learning correction coefficient KBLRC2 is the air/fuel mixture ratio correction value learned for the driving regions which are narrowest in the second preferred embodiment. However, as described above, with the load of the learning correction coefficient KBLRC1 transferred, the correction request is reflected substantially with fidelity.

Hence, a large stepwise difference in the correction levels between the respective driving regions does not occur. However, if the data corresponding to the actual driving condition is read through the linear interpolation as described above. The learning correction coefficient KBLRC2 with respect to the change in the actual driving condition can smoothly be varied. Since the interpolation calculation is carried out with the narrowest driving region as a unit. The interpolation calculation with high accuracy becomes possible. Therefore, even when the corresponding region on the learning map is changed, the learning correction level is not varied in stepwise. According to the request correction level, the learning correction level is not stepwise varied and the learning correction coefficient KBLRC with high accuracy can be varied according to the required correction level.

Therefore, the variation of the air/fuel mixture ratio along with the change in the driving condition can be suppressed.

Figure 13:
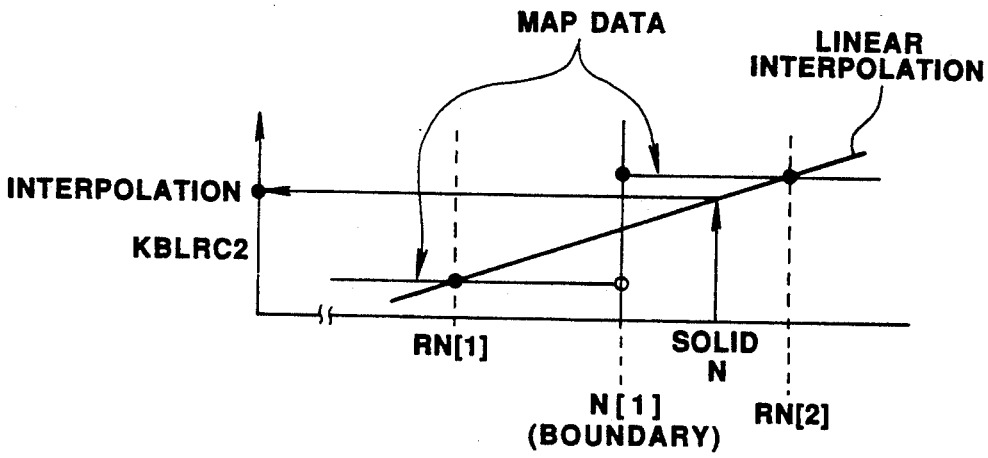
FIG. 13 is a characteristic graph for explaining the interpolation calculation executed in the second preferred embodiment.

It is noted that in the interpolation calculation the CPU derives a center value (Tp [i]−Tp [i−1])/2, (N [i]−N [i−1]/2) of a width of the basic fuel injection quantity Tp [i] and engine revolution speed N, as shown in FIGS. 12 and 13, on the basis of threshold values Tp [i], N [i] divided each 256 driving region learning map. The center value RTp [i], RN [i] has determined to be the driving condition corresponding to the learned correction coefficient KBLRC2 over its region. This is because the learning correction coefficient KBLRC2 learned for the respective driving regions indicates an average correction request at that region and, therefore, is supposed to be the data corresponding to the average driving condition in the region. Therefore, the accuracy of the interpolation calculation is furthermore increased. The center value of the driving condition at the respective regions used for the interpolation may be stored previously in the ROM. However, the calculation may be made on the basis of the threshold value data Tp [i], N [i] in the ROM.

In the second preferred embodiment, the CPU corrects the result of learning so as to impose the correction by means of the learning correction coefficient KBLRC1 on the learning correction coefficient KBLRC2. However, without movement of the correction load between the learning correction coefficient KBLRC1 and learning correction coefficient KBLRC2, the result of addition of the learning correction coefficient KBLRC1 corresponding to the data on the learning correction coefficient KBLRC2 may be used as time discrete data.

Furthermore, although the simple linear interpolation which is simple in the calculation is used in the second preferred embodiment, for example, a three-order interpolation calculation may be used in a case where the burden on the calculation is permitted.

If the learning correction coefficient KBLRC2 corresponding to the actual driving condition is read using the interpolation from the maps, the routine goes to a step S60A in which the final learning correction coefficient KBLRC is set as described below:

KBLRC←KBLRC0+KBLRC2−Target

The learning correction coefficient KBLRC is a correction term which is multiplied by the basic fuel injection quantity Tp. Each learning correction coefficient KBLRC0, KBLRC2 has the initial value learned as the target convergence value Target (=1.0) of the air/fuel mixture ratio feedback correction coefficient LMD. The CPU subtracts the target convergence value Target (=1.0) from the addition value between the learning correction coefficient KBLRC0 corresponding to all driving conditions and the learning correction coefficient KBLRC2 corresponding to the region on the 256 region learning map. It is noted that since all learning correction coefficients KBLRC1 on the 16 region learning maps are reset to the target convergence values Target, the learning correction coefficient KBLRC1 for setting the final learning correction coefficient KBLRC is not considered. However, the learning correction coefficient KBLRC including the learning correction coefficient KBLRC may be set as KBLRC←KBLRC 0+KBLRC2−2×Target.

Figure 9:
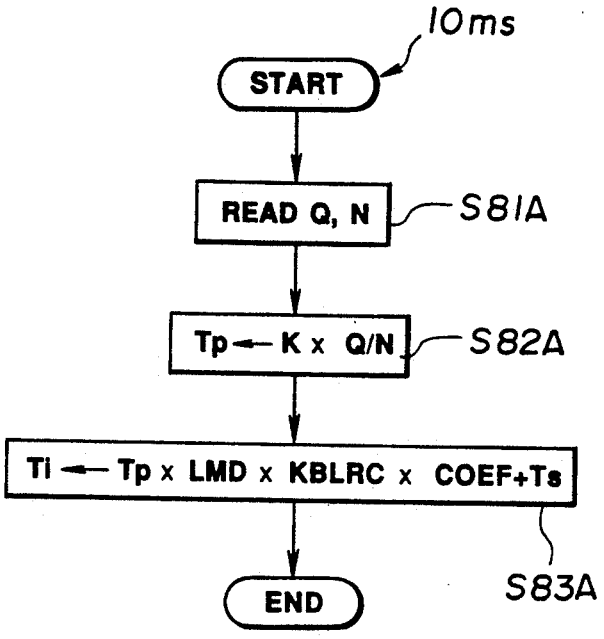
FIG. 9 is an operational flowchart for explaining a setting of a fuel injection quantity in the second preferred embodiment.

The finally set learning correction coefficient KBLRC in the program flowchart shown in FIG. 8 is used in the program flowchart of setting the fuel injection quantity shown in FIG. 9.

The program flowchart shown in FIG. 9 is executed for a predetermined minute time (for example, 10 ms).

In a step S81A, the CPU reads Q, N.

Q denotes the intake air quantity detected by the airflow meter 13. N denotes the engine revolution speed calculated on the basis of the detection pulse signal of the crank angle sensor 14.

In a step S82A, the CPU calculates the basic fuel injection quantity Tp on the basis of the intake air quantity Q and engine revolution speed N as follows:

Tp←K×Q/N, N denotes the constant.

In the next step S83A, the CPU calculates a final fuel injection quantity Ti (fuel supply quantity) from the basic fuel injection quantity Tp with various corrections thereof. Thus, in the step S83A, the CPU updates for the respective predetermined times calculating Ti←Tp×LMD×KBLRC×COEF+Ts, Ts denoting the battery variation correction coefficient.

When the predetermined fuel injection timing is reached, the control unit 12 outputs the drive pulse signal having the pulsewidth corresponding to the latest calculated fuel injection quantity Ti to the fuel injection valve 6 so that the fuel supply quantity to the engine 1 is controlled.

Figure 10:
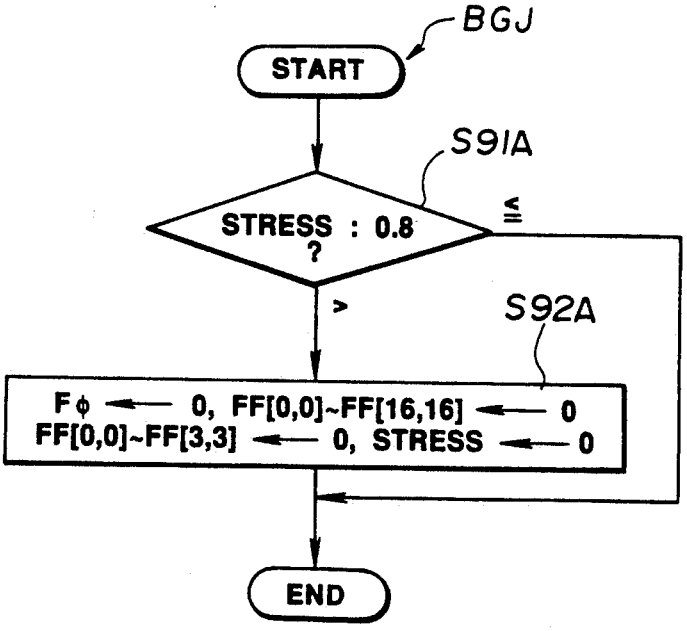
FIG. 10 is an operational flowchart for explaining a content related to an inappropriateness learning control for the learning executed in the second preferred embodiment.

The program flowchart shown in FIG. 10 is a program to process based on stress (an accumulated value of the deviation of the air/fuel mixture ratio to the target convergence value) sampled in accordance with the program flowchart shown in FIGS. 6 (A) and 6 (B).

The program is executed as the BACKGROUND JOB.

In a step S91A, the CPU compares the stress set in the series of flowcharts shown in FIGS. 6 (A) and 6 (B) with the predetermined value (for example, 0.8) with the predetermined value (for example, 0.8), the stress being the parameter indicating the magnitude of inappropriateness of the air/fuel mixture ratio, and determines whether the magnitude of variation in the air/fuel mixture ratio of the air/fuel mixture feedback correction coefficient LMD when the learning is almost ended exceeds a predetermined value.

When the stress exceeds the predetermined value in the step S91A, the CPU determines that the result of learning is inappropriate and deviation of the air/fuel mixture ratio has generated although the learning is almost ended. The routine goes to a step S92A to relearn from the learning correction coefficient KBLRC0.

In a step S92A, the CPU resets to all zeros flags F0, F [0, 0]~F [3, 3], FF [0, 0]~FF [16, 16] to determine whether the air/fuel mixture ratio learning for the respective driving regions is ended. Since the learning is restarted, the stress is also reset to zero.

In the way described above, if the magnitude of deviation of the air/fuel mixture ratio feedback correction coefficient LMD to a reference value exceeds a predetermined value, the learning is restarted. For example, when the air/fuel mixture ratio abruptly changes due to an accident such as making a hole through the intake air system of the engine 1, the learning for each large driving region is again carried out so that the air/fuel mixture ratio can speedily be converged to the target air/fuel mixture ratio.

As described hereinabove, since in the air/fuel mixture ratio learning and controlling system according to the present invention a close learning for each close driving region which can cope with the difference in the driving conditions can be achieved with the convergence speed of the learning secured. Then, since the learning correction value of the air/fuel mixture ratio can smoothly be changed by means of the accurate interpolation calculation. Consequently, the worse condition of the exhaust gas characteristic due to the variation in the air/fuel mixture ratio can be prevented when the driving regions of the learning maps are changed.

Other various effects can be achieved according to the present invention.

It will fully be appreciated by those skilled in the art that the foregoing description has been made to the preferred embodiments and various changes and modifications may be made without departing from the scope of the present invention which is to be defined by the appended claims.

What is claimed is:

1. A system for learning and controlling an air/fuel mixture ratio for an internal combustion engine, comprising:

a) first means for detecting an engine driving condition including a driving parameter related to an intake air quantity sucked into the engine;

b) second means for setting a basic fuel supply quantity on the basis of the engine driving condition;

c) third means for detecting the air/fuel mixture ratio of the intake air mixture fuel;

d) fourth means for comparing the detected air/fuel mixture ratio with a target air/fuel mixture ratio and for setting an air/fuel mixture ratio feedback correction coefficient used to correct the basic fuel supply quantity so as to make the actual air/fuel mixture ratio approach to the target air/fuel mixture ratio;

e) fifth means for rewritably storing a learning correction coefficient for each driving region, a whole driving region being divided into a plurality of driving regions according to the engine driving condition, the learning correction coefficient being used to correct the basic fuel supply quantity;

f) sixth means for learning a deviation of a value of the air/fuel mixture ratio feedback correction coefficient to a target convergence value and for modifying and rewriting the air/fuel mixture ratio learning correction coefficient stored so as to correspond to one of the driving regions in the fifth means so that the deviation thereof is reduced;

g) seventh means for determining the present corresponding driving region in the fifth means as a learned region when the value of the air/fuel mixture ratio feedback correction coefficient substantially coincides with the target convergence value and for storing a result of determination of the learned region according to each driving region;

h) eighth means for estimatingly learning the air/fuel mixture ratio learning correction coefficients corresponding to the other driving regions which are adjacent in terms of the driving condition to one of the driving regions at which the corresponding learning correction coefficient is rewritten by the sixth means;

i) ninth means for controlling the estimatingly learning of the eighth means according to a number of rewritten driving regions at which the corresponding air/fuel mixture ratio learning correction coefficients are rewritten by the eighth means together with the rewritten learning correction coefficient by the sixth means such that the number of the rewritten driving regions is decreased as the number of learned driving regions is increased; and j) tenth means for driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

2. A system for learning and controlling an air/fuel mixture ratio for an internal combustion engine as set forth in claim 1, which further includes: eleventh means for determining a magnitude of inappropriateness of the result of learning the air/fuel mixture ratio on the basis of the deviation of the air/fuel mixture ratio correction value from the target convergence value when the driving region is changed to the other one of the driving regions; and twelfth means for reducing the number of the driving regions at which the learning correction coefficients are learned as the learnings are advanced with the number of the other regions at which the learning correction coefficients are rewritten together with the learning correction coefficient of the region to be rewritten by means of the sixth means.

3. A system for learning and controlling an air/fuel mixture ratio for an internal combustion engine as set forth in claim 2, wherein the value of the deviation of the air/fuel mixture ratio from the target convergence value is expressed as follows:

$(a+b)/2=\text{Target}$ (1.0), wherein a denotes a maximum value of the air/fuel mixture ratio feedback correction coefficient LMD, b denotes a minimum value thereof, and Target denotes the target convergence value thereof.

4. A system for learning and controlling an air/fuel mixture ratio for an internal combustion engine as set forth in claim 3, wherein said sixth means learns the deviation of the value of the air/fuel mixture ratio correction coefficient LMD to the target convergence value whenever a reverse of rich or lean state of the actual air/fuel mixture ratio with respect to the target air/fuel mixture ratio occurs.

5. A system for learning and controlling an air/fuel mixture ratio for an internal combustion engine as set forth in claim 4, wherein the fifth means includes a learning map in which the whole driving region is divided into 256 ($=16\times16$) regions according to the basic fuel supply quantity Tp and engine revolution speed N and wherein an initial value of each learning correction coefficient at the corresponding driving region is 1.0.

6. A system for learning and controlling an air/fuel mixture ratio for an internal combustion engine as set forth in claim 5, wherein the eleventh means includes a counter of Δ Stress indicating the magnitude of inappropriateness of the result of learning and which is set on the basis of an absolute value of the deviation between the average value of a and b and the target convergence value (=1.0) whenever the present engine driving region is changed to the other one of the driving regions and the value of the Δ Stress is accumulated into an accumulator of [Stress] whenever the reverse of the air/fuel mixture ratio occurs.

7. A system for learning and controlling an air/fuel mixture ratio for an internal combustion engine as set forth in claim 6, which further includes thirteenth means for determining whether the contents of [Stress] exceeds a predetermined value and determines the learning of the whole learning correction coefficient again when determining that the contents of [Stress] exceeds the predetermined value.

8. A system for learning and controlling an air/fuel mixture ratio for an internal combustion engine as set forth in claim 7, wherein the number of learned regions is indicated by a flag Status, the flag Status being set according to a flag Flag [I], [K] which is set to 1 when the learning of the learning correction coefficient KBLRC of the region denoted by [I], [K] of the learning map is ended.

9. A system for learning and controlling an air/fuel mixture ratio for an internal combustion engine as set forth in claim 8, wherein said eighth means includes an estimation learning counter ZZ which is set to zero when the contents of the counter States indicates a maximum number of the divided regions and which contents are reduced as the increase in the number of the learned regions.

10. A system for learning and controlling an air/fuel mixture ratio for an internal combustion engine as set forth in claim 9, the learning correction coefficient KBLRC is modified and rewritten as follows:

$$KBLRC \leftarrow KBLRC[I][K] + ((a+b)/2 - 1.0) \times i.$$

11. A system for learning and controlling an air/fuel mixture ratio for an internal combustion engine as set forth in claim 1, wherein the sixth means carries out the learning of the air/fuel mixture ratio such that the learning correction coefficient is modified and rewritten so as to reduce the deviation thereof and such that a range of the driving regions at which the learning correction coefficients are modified and rewritten becomes stepwisely narrowed as the learnings of the learning correction coefficients are advanced.

12. A system for learning and controlling an air/fuel mixture ratio for an internal combustion engine as set forth in claim 10, wherein said fifth means includes a plurality of learning maps, a first learning map having first learning correction coefficients KBLRC1 for respectively divided driving regions of the whole driving region, the whole driving region being divided into 16 driving regions according to the basic fuel supply quantity Tp and engine revolution speed N, a second learning map having second learning correction coefficients KBLRC2 for respectively divided driving regions of the whole driving region, the whole driving region being divided into 256 driving regions according to the basic fuel supply quantity Tp and engine revolution speed N, and a third learning map having a third learning map having a third learning correction coefficient KBLRC0 for the whole driving region.

13. A system for learning and controlling an air/fuel mixture ratio for an internal combustion engine as set forth in claim 12, which further includes eleventh means for calculating an interpolation between the narrowest driving regions which correspond to the present driving condition, the learning correction coefficients for the narrowest driving regions being learned when reading the learning correction coefficient for the present engine driving condition.

14. A system for learning and controlling an air/fuel mixture ratio for an internal combustion engine as set forth in claim 13, wherein said tenth means derives the final fuel supply quantity Ti on the basis of the basic fuel supply quantity Tp, air/fuel mixture ratio feedback correction coefficient LMD, and air/fuel mixture ratio learning correction coefficient read by the eleventh means.

15. A system for learning and controlling an air/fuel mixture ratio for an internal combustion engine as set forth in claim 14, wherein the interpolation calculation by the eleventh means is a linear interpolation such as to derive the air/fuel mixture ratio learning correction coefficient corresponding to the present driving condition, with a substantially center value of a width of the driving condition between the narrowest driving regions set as the present driving condition corresponding to the read learning correction coefficient, the center value being expressed as follows: $(Tp[i]-Tp[i-1])/2$, $(N[i]-N[i-1])/2$, wherein Tp [i], N[i] denote threshold values of the basic fuel supply quantity Tp and engine revolution speed N crossing the respective driving regions of the second learning map.

16. A system for learning and controlling an air/fuel mixture ratio for an internal combustion engine as set forth in claim 15, wherein the learnings for the learning correction coefficients are carried out starting from the third learning correction coefficient KBLRC0, thereafter, the first learning correction coefficients KBLRC1, and lastly the second learning correction coefficients KBLRC2.

17. A system for learning and controlling an air/fuel mixture ratio for an internal combustion engine as set forth in claim 16, wherein the narrowest driving regions are in the second map having the learned regions at which the learnings of the second learning correction coefficients KBLRC2 are carried out.

18. A system for learning and controlling an air/fuel mixture ratio for an internal combustion engine as set forth in claim 17, the read learning correction coefficient by the eleventh means is expressed below: $KBLRC \leftarrow KBLRC0 + KBLRC2 - Target$.

19. A system for learning and controlling an air/fuel mixture ratio for an internal combustion engine as set forth in claim 18, the read learning correction coefficient by the eleventh means is expressed below: $KBLRC \leftarrow KBLRC0 + KBLRC1 - 2 \times Target$.

20. A system for learning and controlling an air/fuel mixture ratio for an internal combustion engine, comprising:

a) first means for detecting an engine driving condition including a driving parameter related to an intake air quantity sucked into the engine;

b) second means for setting a basic fuel supply quantity on the basis of the engine driving condition;

c) third means for detecting the air/fuel mixture ratio of the intake air mixture fuel;

d) fourth means for comparing the detected air/fuel mixture ratio with a target air/fuel mixture ratio and for setting an air/fuel mixture ratio feedback correction coefficient used to correct the basic fuel supply quantity so as to make the actual air/fuel mixture ratio approach to the target air/fuel mixture ratio;

e) fifth means having at least one learning map for rewritably storing a learning correction coefficient for each driving region, a whole driving region being divided into a plurality of driving regions according to the engine driving condition, the learning correction coefficient being used to correct the basic fuel supply quantity;

f) sixth means for learning a deviation of a value of the air/fuel mixture ratio feedback correction coefficient to a target convergence value and for modifying and rewriting the air/fuel mixture ratio learning correction coefficient stored so as to correspond to one of the driving regions in the fifth means so that the deviation thereof is reduced;

g) seventh means for determining the present corresponding driving region in the fifth means as a learned region when the value of the air/fuel mixture ratio feedback correction coefficient substantially coincides with the target convergence value and for storing a result of determination of the learned region according to each driving region;

h) eighth means for learning the air/fuel mixture ratio learning correction coefficients corresponding to the other driving regions so as to prevent a stepwise difference between the learning correction coefficients in the learning map of the fifth means when the driving conditions varied from the one driving region to one of the other driving regions, the other driving regions being adjacent in terms of the driving condition to the one driving region at which the corresponding learning correction coefficient is rewritten by the sixth means;

i) ninth means for controlling the estimating and learning of the eighth means according to a number of rewritten driving regions at which the corresponding air/fuel mixture ratio learning correction coefficients are rewritten by the eighth means together with the rewritten learning correction coefficient by the sixth means such that the number of the rewritten driving regions is decreased as the number of learned driving regions is increased; and j) tenth means for driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

21. A method for learning and controlling an air/fuel mixture ratio for an internal combustion engine, comprising the steps of:

a) detecting an engine driving condition including a driving parameter related to an intake air quantity sucked in to the engine;

b) setting a basic fuel supply quantity on the basis of the engine driving conditions;

c) detecting the air/fuel mixture ratio of the intake air mixture fuel;

d) comparing the detected air/fuel mixture ratio with a target air/fuel mixture ratio and setting an air/fuel mixture ratio feedback correction coefficient used to correct the basic fuel supply quantity so as to make the actual air/fuel mixture ratio approach to the target air/fuel mixture ratio;

e) rewritably storing a learning correction coefficient for each driving region, a whole driving region being divided into a plurality of driving regions according to the engine driving condition, the learning correction coefficient being used to correct the basic fuel supply quantity;

f) learning a deviation of a value of the air/fuel mixture ratio feedback correction coefficient to a target convergence value and modifying and rewriting the air/fuel mixture ratio learning correction coefficient stored so as to correspond to one of the driving regions so that the deviation thereof is reduced;

g) determining the present corresponding driving region in the fifth means as a learned region when the value of the air/fuel mixture ratio feedback correction coefficient substantially coincides with the target convergence value and for storing a result of determination of the learned region according to each driving region;

h) estimating and learning the air/fuel mixture ratio learning correction coefficients corresponding to the other driving regions which are adjacent in terms of the driving condition to one of the driving regions at which the corresponding learning correction coefficient is rewritten in the step e);

i) controlling the estimation and learning carried out in the step h) according to a number of rewritten driving regions at which the corresponding air/fuel mixture ratio learning correction coefficients are rewritten by the eighth means together with the rewritten learning correction coefficient in the step e) such that the number of the rewritten driving regions is decreased as the number of learned driving regions is increased; and j) driving a final fuel supply quantity on the basis of the basic fuel supply quantity, air/fuel mixture ratio feedback correction value, and air/fuel mixture ratio learning correction coefficient stored so as to correspond to the present driving region, the final quantity being a quantity of fuel to be supplied to the engine.

* * * * *